US011732482B2

(12) United States Patent
Burt et al.

(10) Patent No.: US 11,732,482 B2
(45) Date of Patent: Aug. 22, 2023

(54) VERTICAL CABLE BARRIER HAVING RAILS WITH INTERNAL CABLE FITTING ENGAGEMENT FEATURES

(71) Applicant: Fortress Iron, LP, Garland, TX (US)

(72) Inventors: Kevin Troy Burt, Dallas, TX (US); Geoff T. Luczycki, Dallas, TX (US); Kevin Brady Flatt, Coppell, TX (US); Collin Michael Robinson, Garland, TX (US)

(73) Assignee: Fortress Iron, LP, Garland, TX (US)

( * ) Notice: Subject to any disclaimer, the term of this patent is extended or adjusted under 35 U.S.C. 154(b) by 0 days.

(21) Appl. No.: 17/151,149

(22) Filed: Jan. 16, 2021

(65) Prior Publication Data

US 2021/0222436 A1 Jul. 22, 2021

Related U.S. Application Data

(60) Provisional application No. 62/962,601, filed on Jan. 17, 2020.

(51) Int. Cl.
*E04F 11/18* (2006.01)

(52) U.S. Cl.
CPC ..... *E04F 11/1817* (2013.01); *E04F 11/1859* (2013.01); *E04F 2011/1823* (2013.01)

(58) Field of Classification Search
CPC ..... E04F 11/18; E04F 11/181; E04F 11/1817; E04F 11/1836; E04F 11/1842;
(Continued)

(56) References Cited

U.S. PATENT DOCUMENTS 10,781 A 4/1854 Coons
56,766 A 7/1866 Larmore
(Continued)

FOREIGN PATENT DOCUMENTS

AU 2012101279 A4 9/2012
DE 29509791.9 U1 10/1995
(Continued)

OTHER PUBLICATIONS

Balustrades Australia VB2 Technical Manual—Pool Fencing and Balustrades; VB2 Technical Manual; Black Rock Balustrades (http://blackrockbalustrades.com.au); 21 pages.
(Continued)

*Primary Examiner* — Jonathan P Masinick
(74) *Attorney, Agent, or Firm* — Foley & Lardner LLP; John J. May

(57) ABSTRACT

A rail panel includes a top rail defining a plurality of fastener receiving holes and a plurality of top cable holes. The rail panel includes a bottom rail defining a plurality of bottom cable holes and a plurality of clip receiving holes. The rail panel includes a plurality of vertical cables extending from the top rail to the bottom rail. The rail panel includes a plurality of threaded swage fittings, each coupled to a respective top end of one of the plurality of vertical cables, and a plurality of clip receiving swage fittings, each coupled to a respective bottom end of one of the plurality of vertical cables, and a plurality of clips, each received by a respective clip receiving swage fitting.

20 Claims, 14 Drawing Sheets

(58) Field of Classification Search
CPC ..... E04F 11/1844; E04F 11/1859; E04F 2011/1823; E04F 2011/1825; E04F 2011/1827; E04F 2011/1829; E04F 2011/1831; E04F 2011/1834
See application file for complete search history.

(56) References Cited

U.S. PATENT DOCUMENTS

| | | | | |
|---|---|---|---|---|
| 319,057 | A * | 6/1885 | Bickley | E04H 17/20 256/48 |
| 341,359 | A | 5/1886 | Stillman | |
| 489,116 | A | 1/1893 | Banta | |
| 607,410 | A | 7/1898 | Martin et al. | |
| 680,438 | A | 8/1901 | Pierce | |
| 753,227 | A | 3/1904 | Bounds | |
| 1,714,388 | A | 5/1929 | Mcbride | |
| 3,313,527 | A | 4/1967 | Eriksson | |
| 3,596,880 | A | 8/1971 | Greenberg | |
| 3,648,982 | A | 3/1972 | Sabel et al. | |
| 3,955,799 | A | 5/1976 | Lauzier | |
| 4,190,234 | A | 2/1980 | Coleman | |
| 4,433,831 | A | 2/1984 | Bunger | |
| 4,475,840 | A * | 10/1984 | Schmitt | E04F 11/1817 403/22 |
| 5,186,497 | A | 2/1993 | Van Pinkerton, Jr. | |
| 5,613,664 | A | 3/1997 | Svalbe | |
| 5,649,688 | A | 7/1997 | Baker | |
| 6,053,281 | A | 4/2000 | Murray | |
| 6,135,424 | A | 10/2000 | Bracke | |
| 6,679,480 | B1 | 1/2004 | Hara et al. | |
| 6,874,766 | B2 | 4/2005 | Curatolo | |
| 6,902,151 | B1 | 6/2005 | Nilsson | |
| 6,962,328 | B2 | 11/2005 | Bergendahl | |
| 6,964,138 | B2 | 11/2005 | Carroll et al. | |
| 7,044,448 | B1 | 5/2006 | Jones | |
| 7,152,849 | B2 | 12/2006 | Graber | |
| 7,168,689 | B2 | 1/2007 | Giralt | |
| 7,198,253 | B2 | 4/2007 | Striebel et al. | |
| 7,249,908 | B2 | 7/2007 | Bergendahl et al. | |
| 7,370,452 | B2 | 5/2008 | Rogers | |
| 7,540,472 | B2 | 6/2009 | Striebel et al. | |
| 7,744,065 | B2 | 6/2010 | Terrels et al. | |
| 7,889,075 | B2 | 2/2011 | Winkler et al. | |
| 7,913,983 | B1 | 3/2011 | Sandor, Sr. | |
| 7,988,133 | B2 | 8/2011 | Gripne et al. | |
| 8,157,471 | B2 | 4/2012 | Bergendahl et al. | |
| 8,814,145 | B2 | 8/2014 | Herman | |
| 9,126,289 | B2 * | 9/2015 | Herman | E04H 17/24 |
| 9,145,705 | B2 | 9/2015 | Herman | |
| 9,194,155 | B2 | 11/2015 | Landry | |
| 9,249,577 | B2 * | 2/2016 | Ross | E04H 17/10 |
| 9,689,410 | B2 | 6/2017 | Ostervig | |
| 9,790,707 | B2 | 10/2017 | Burt et al. | |
| 9,896,864 | B2 * | 2/2018 | Zhu | E04H 17/22 |
| 9,932,754 | B2 * | 4/2018 | Schlatter | E04H 17/06 |
| 9,976,320 | B2 | 5/2018 | Burt et al. | |
| 10,221,522 | B1 * | 3/2019 | Henderson | F16B 35/005 |
| 10,450,774 | B2 | 10/2019 | Herman | |
| 10,538,940 | B2 | 1/2020 | Burt et al. | |
| 10,883,290 | B2 | 1/2021 | Burt et al. | |
| 10,975,591 | B2 * | 4/2021 | Kennedy | E04H 17/04 |
| 11,236,512 | B2 | 2/2022 | Williams et al. | |
| 11,300,180 | B2 * | 4/2022 | Graber | E04F 11/1842 |
| 2004/0079930 | A1 | 4/2004 | Aubin | |
| 2004/0188663 | A1 | 9/2004 | Stein | |
| 2005/0071958 | A1 | 4/2005 | Toimil | |
| 2006/0151760 | A1 | 7/2006 | Vyvyan-Vivian | |
| 2008/0106408 | A1 | 5/2008 | Winkler et al. | |
| 2009/0050865 | A1 | 2/2009 | Napier | |
| 2009/0224222 | A1 | 9/2009 | Dezen et al. | |
| 2009/0321699 | A1 | 12/2009 | Payne | |
| 2010/0012910 | A1 | 1/2010 | Napier | |
| 2010/0219390 | A1 | 9/2010 | O'Banion et al. | |
| 2010/0278609 | A1 | 11/2010 | Wreford | |
| 2010/0288991 | A1 | 11/2010 | Derogatis et al. | |
| 2010/0301297 | A1 | 12/2010 | Chapman | |
| 2010/0308293 | A1 | 12/2010 | Larkins et al. | |
| 2011/0073823 | A1 | 3/2011 | Mitrovic | |
| 2011/0109025 | A1 | 5/2011 | Sechler | |
| 2012/0168703 | A1 | 7/2012 | Napier | |
| 2013/0020546 | A1 | 1/2013 | Truckner | |
| 2013/0069026 | A1 | 3/2013 | Bergendahl et al. | |
| 2014/0054530 | A1 | 2/2014 | Petta | |
| 2014/0138596 | A1 | 5/2014 | Ross | |
| 2014/0332745 | A1 | 11/2014 | Marconi | |
| 2015/0041743 | A1 | 2/2015 | Richison et al. | |
| 2015/0204104 | A1 | 7/2015 | Ostervig | |
| 2015/0252588 | A1 | 9/2015 | Springborn | |
| 2016/0083975 | A1 | 3/2016 | Herman | |
| 2017/0362854 | A1 | 12/2017 | Burt et al. | |
| 2018/0094450 | A1 | 4/2018 | Sorkin | |
| 2018/0298633 | A1 | 10/2018 | Herman | |
| 2020/0048928 | A1 | 2/2020 | Herman | |
| 2020/0080620 | A1 | 3/2020 | Graber et al. | |

FOREIGN PATENT DOCUMENTS

| | | | |
|---|---|---|---|
| DE | 19945564.3 | A1 | 3/2001 |
| DE | 10 2010 033 949 | A1 | 2/2012 |
| DE | 10 2011 121 073 | | 3/2013 |
| FR | 3000531 | | 7/2014 |
| GB | 0 413 928 | | 7/1934 |
| GB | 2 420 544 | | 5/2006 |
| JP | 4744307 | B2 | 8/2011 |
| JP | 4823937 | B2 | 11/2011 |
| WO | WO-2004/037492 | A1 | 5/2004 |
| WO | WO-2007/124533 | A1 | 11/2007 |

OTHER PUBLICATIONS

Defendant's Preliminary Invalidity Contention; Cause No. 3:21-CV-00014; Plaintiff—*Fortress Iron, L.P.* v. Defendant—*Digger Specialties, Inc.*; 429 pages.

International Search Report and Written Opinion on International Application No. PCT/US2015/025563 dated Jul. 14, 2015, 11 pages.

International Search Report and Written Opinion on International Application No. PCT/US2015/025567 dated Jul. 14, 2015, 13 pages.

International Search Report and Written Opinion on International Application No. PCT/US2021/013775, dated Apr. 7, 2021, 14 pages.

Brochure, CableRail Step-by-Step Installation for Metal Frames, Feeny, Inc., Copyright 2012, 2 pps.

Brochure, Installation Instructions for Fortress Fe26 Posts on a Wood Deck, the Fortress Company, Undated, 2 pps.

Brochure, Railing for the Good Life, PolyRAIL Systems, Digger Specialties Inc., Undated, 20 pps.

Brochure, The Cable Connection's Ultra-tec Cable Railing Components, The Cable Connection, Apr. 1, 2006, 4 pps.

Brochure, Ultra-tec Cable Railing Systems, Section 05720, Cable and Railing Hardware Product Catalog, Mar. 1, 2006, Ultra-tec Cable Railing Systems, 11 pps.

Brochure, Westbury Aluminum Railing, Digger Specialties Inc., Copyright 2012, 20 pps.

Classic Fence, The Fortress Company, Archived Screenshot from The Wayback Machine dating May 11, 2011, 2 pps., Retrieved Oct. 31, 2022.

Design Parameters and Constraints, Ultra-tec Cable Railing Systems, Jan. 1, 2005, pp. 2-3, 2 pps.

Detailed Drawings for Vertical Railings, Ultra-tec Cable Railing Systems, Jan. 1, 2005, p. 3, 1 p.

Fe26 Iron Railing for Decking, The Fortress Company, Archived Screenshot from The Wayback Machine dating Dec. 29, 2013, 3 pps., Retrieved Oct. 31, 2022.

Fortress Frequently Asked Questions, The Fortress Company, Archived Screenshot from The Wayback Machine dating May 19, 2011, 2 pps., Retrieved Oct. 31, 2022.

(56) References Cited

OTHER PUBLICATIONS

*Fortress Iron L.P.* v. *Digger Specialties, Inc.*, Cause No. 3:21-CV-00014 in the U.S. Dist. Ct., Northern Dist. of Indiana, South Bend Div., Defendant's Final Invalidity Contentions, dated Nov. 7, 2022, 63 pps.
*Fortress Iron L.P.* v. *Digger Specialties, Inc.*, Cause No. 3:21-CV-00014 in the U.S. Dist. Ct., Northern Dist. of Indiana, South Bend Div., Defendant's Final Invalidity Contentions, Exhibit A, dated Nov. 7, 2022, 172 pps.
*Fortress Iron L.P.* v. *Digger Specialties, Inc.*, Cause No. 3:21-CV-00014 in the U.S. Dist. Ct., Northern Dist. of Indiana, South Bend Div., Defendant's Final Invalidity Contentions, Exhibit B, dated Nov. 7, 2022, 301 pps.
Fortress Product Gallery, The Fortress Company, Archived Screenshot from The Wayback Machine dating Mar. 3, 2011, 3 pps., Retrieved Oct. 31, 2022.
Fortress Railing Products—Ornamental Railing Products, Wrought Iron, Steel & Glass Railing, Panel Systems & Balusters, The Fortress Company, Archived Screenshot from The Wayback Machine dating Feb. 7, 2014, 1 p., Retrieved Oct. 31, 2022.
Fortress Railing Products, Al 13 Aluminum Railing, The Fortress Company, Archived Screenshot from The Wayback Machine dating Feb. 11, 2014, 2 pps., Retrieved Oct. 31, 2022.
Fortress Railing, The Fortress Company, Archived Screenshot from The Wayback Machine dating Feb. 7, 2014, 2 pps., Retrieved Oct. 31, 2022.
Handrail & Pool Fencing—Cablestrade—Vertical Cable System, Cablestrade Pty Ltd., Archived Screenshots from The Wayback Machine dating Dec. 21, 2008, Dec. 19, 2008, Jun. 2, 2009, Aug. 27, 2013, Aug. 28, 2013, and Jan. 5, 2010, all accessed Oct. 17, 2022, 8 pps.
Installation Instructions, The Fortress Company, Archived Screenshot from The Wayback Machine dating May 15, 2014, 2 pps., Retrieved Oct. 31, 2022.
Mid Rail Specifications, Nov. 3, 2009, 1 p.
Photo, Raven Bottom Rail & Insert, Undated.
Photo, Riviera Mid Rail & Insert, Undated.
PVC Insert H Specifications, Nov. 3, 2009, 1 p.
Raven Detail Specifications, Dec. 5, 2005, Raven Railing, PolyRail Vinyl Railing, 1 p.
Standard CableRail Assemblies, Feeny, Inc., Archived Screenshot from The Wayback Machine dating Jul. 2, 2013, 11 pps.
Ultra-tec Cable Railing System, Features That Make Ultra-Tec Systems Unique, Archived Screenshot from The Wayback Machine dating Mar. 19, 2006, 2 pps.
Ultra-tec Cable Railing System, Photo Gallery—Decks, Archived Screenshot from The Wayback Machine dating Mar. 19, 2006, 2 pps.
Ultra-tec Cable Railing System, Photo Gallery—Guard Railings, Archived Screenshot from The Wayback Machine dating Mar. 19, 2006, 3 pps.
Ultra-tec Cable Railing Systems, Hardware Mounting Holes Boring Guide for Metal Railings, The Cable Connection, Mar. 1, 2006, 16 pps.
Ultra-tec Framing Systems, The Cable Connection, Archived Screenshot from The Wayback Machine dating Mar. 19, 2006, 1 p.
Versai Ornametal Fence, The Fortress Company, Archived Screenshot from The Wayback Machine dating Nov. 5, 2010, 2 pps., Retrieved Oct. 31, 2022.
Vertical Railing Boring Diagrams, Ultra-tec Cable Railing Systems, Jan. 1, 2005, p. 7, 1 p.
Vertical Railings Hardware to Specify, Vertical Railings Other Construction Notes, Ultra-tec Cable Railing Systems, Jan. 1, 2005, p. 8, 1 p.
Vertical Railings, Ultra-tec Cable Railing Systems, Jan. 1, 2005, p. 2, 1 p.
Welcome to The Cable Connection, Company Profile, The Cable Connection, Archived Screenshot from The Wayback Machine dating Dec. 31, 2005, Copyright 2003, 2 pps.
Work Order Traveler, Work Order Id: WO-0000428/1, Digger Specialties, Inc., Oct. 11, 2022, 2 pps.
Work Order Traveler, Work Order Id: WO-0317791/INA, Digger Specialties, Inc., Oct. 11, 2022, 2 pps.
Defendant Digger Specialties' Opening Claim Construction Brief (with appendix); Case No. 3:21-CV-00014; Plaintiff—*Fortress Iron, L.P.* v. Defendant—*Digger Specialties, Inc.*; Nov. 16, 2021; 888 pages.
Plaintiff Fortress Iron L.P.'s Opening Claim Construction Brief; Case No. 3:21-CV-00014; Plaintiff—*Fortress Iron, L.P.* v. Defendant—*Digger Specialties, Inc.*; Nov. 16, 2021; 136 pages.
Defendant Digger Specialties' Response to Plaintiff's Opening Claim Construction Brief; Case No. 3:21-CV-00014; Plaintiff—*Fortress Iron, L.P.* v. Defendant—*Digger Specialties, Inc.*; Dec. 7, 2021; 17 pages.
Plaintiff Fortress Iron L.P.'s Response Claim Construction Brief; Case No. 3:21-CV-00014; Plaintiff—*Fortress Iron, L.P.* v. Defendant—*Digger Specialties, Inc.*; Dec. 7, 2021; 21 pages.
Opinion and Order; Case No. 3:21-CV-00014; Plaintiff—*Fortress Iron, L.P.* v. Defendant—*Digger Specialties, Inc.*; Aug. 8, 2022; 22 pages.
Brochure, Ultra-tec Cable Railing Components, The Cable Connection, Apr. 1, 2006, 4 pps.
Aluminum Railing Instructions, DesignRail, Vertical Cable Systems, AF# 2010-307E, Undated, 8 pps.
Brochures for Feeney Architectural Products, including Product Line, 05 73 00/FEE Buyline 2506, Aug. 19, 2008; DesignRail Aluminum Railing Systems, Jul. 24, 2008; and Cable Rail Standard Cable Assemblies, Jul. 24, 2008; Cable Rail Custom Cable Assemblies, Jul. 24, 2008; Feeney Architectural Products, 4 pps.
*Fortress Iron L.P.* v. *Digger Specialties, Inc.*, Cause No. 3:21-CV-00014 in the U.S. Dist. Ct., Northern Dist. of Indiana, South Bend Div., Defendant Digger Specialties, Inc.'s Motion for Leave to Supplement Invalidity Contentions, dated Feb. 8, 2023, 55 pps.
Aluminum Railing Instructions, DesignRail, Vertical Cable Systems, V2012, Feeney, 4 pps .<http://www.feeneyinc.com/site/Technical/DesignRail/INSTALLATION%20INSTRUCTIONS/DR_VertCable_Install-2012.pdf>, 4 pages Apr. 22, 2013, retrieved from Internet Archive Wayback Machine, https://web.archive.org/web/20130422141250/http://www.feeneyinc.com/site/Technical/DesignRail/INSTALLATION%20INSTRUCTIONS/DR_VertCable_Install-2012.pdf> on Mar. 2, 2023.
Assembly Diagram for Vertical Cable Infill for Series 400 Top-Rail, Feeney, Feb. 25, 2009, 1 p.
Assembly Diagram for Vertical Cable Infill for Series 400, Dec. 9, 2009, Feeney, 1 p.
Specifications for Vertical Cable Infill, Dwg # Rail V-Cable Rev 1, Feeney Architectural Products, Nov. 2007, 1 p.
U.S. Reg. No. 3528156 for Designrail, Bibliographic Data, Feeney, Inc., status date May 8, 2018, generated by TSDR on Jan. 5, 2023, 175 pps.
U.S. Reg. No. 3528156 for Designrail, Registration Bibliographic Data and Specimens from U.S. Patent and Trademark Office including product information brochures, Feeney, Inc., status date May 8, 2018, generated by TSDR on Jan. 6, 2023, 16 pps.
Statement of Use, Serial No. 77/086118 for Designrail, Bibliographic Data and Specimens from U.S. Patent and Trademark Office including product information brochures, Feeney, Inc., date Sep. 2, 2008, generated by TSDR on Jan. 5, 2023, 19 pps.
*Fortress Iron L.P.* v. *Digger Specialties, Inc.*, Cause No. 3:21-cv-00014-RLM-MGG in the U.S. District Court of Northern Dist. of Indiana, South Bend Div., Plaintiff's Rebuttal Expert Report of Dr. John D. Pratt to Defendant's Expert Report Regarding Invalidity of U.S. Pat. No. 9,790,707 and U.S. Pat. No. 10,883,290, dated Jun. 8, 2023; pp. 67.
*Fortress Iron L.P.* v. *Digger Specialties, Inc.*, Cause No. 3:21-cv-00014-RLM-MGG in the U.S. District Court of Northern Dist. of Indiana, South Bend Div., Exhibit A-Y to Plaintiff's Rebuttal Expert Report of Dr. John D. Pratt to Defendant's Expert Report Regarding Invalidity of U.S. Pat. No. 9,790,707 and U.S. Pat. No. 10,883,290, dated Jun. 8, 2023; pp. 270.
*Fortress Iron L.P.* v. *Digger Specialties, Inc.*, Cause No. 3:21-CV-00014 in the U.S. Dist. Ct., Northern Dist. of Indiana, South Bend

(56) References Cited

OTHER PUBLICATIONS

Div., Opening Expert Report of John D. Pratt, Ph.D., P.E. Regarding Infringement of U.S. Pat. No. 9,790,707 and U.S. Pat. No. 10,883,290, dated May 4, 2023, 44 pps.
*Fortress Iron L.P.* v. *Digger Specialties, Inc.*, Cause No. 3:21-CV-00014 in the U.S. Dist. Ct., Northern Dist. of Indiana, South Bend Div., Opening Expert Report on Infringement Exhibit 5, '707 Claim Charts, dated May 4, 2023, 25 pps.
*Fortress Iron L.P.* v. *Digger Specialties, Inc.*, Cause No. 3:21-CV-00014 in the U.S. Dist. Ct., Northern Dist. of Indiana, South Bend Div., Opening Expert Report on Infringement Exhibit 6, '290 Claim Charts, dated May 4, 2023, 172 pps.
*Fortress Iron L.P.* v. *Digger Specialties, Inc.*, Cause No. 3:21-CV-00014 in the U.S. Dist. Ct., Northern Dist. of Indiana, South Bend Div., Expert Report of Glenn Akhavein Concerning Invalidity, dated May 4, 2023, 568 pps.
*Fortress Iron L.P.* v. *Digger Specialties, Inc.*, Cause No. 3:21-CV-00014 in the U.S. Dist. Ct., Northern Dist. of Indiana, South Bend Div., Revised Exhibit A to Final Invalidity Contentions, dated May 2023, 185 pps.
*Fortress Iron L.P.* v. *Digger Specialties, Inc.*, Cause No. 3:21-CV-00014 in the U.S. Dist. Ct., Northern Dist. of Indiana, South Bend Div., Revised Exhibit B to Final Invalidity Contentions, dated May 2023, 377 pps.

* cited by examiner

VERTICAL CABLE BARRIER HAVING RAILS WITH INTERNAL CABLE FITTING ENGAGEMENT FEATURES

PRIORITY CLAIM

This application claims priority from United States Provisional Application for Patent No. 62/962,601 filed Jan. 17, 2020, the disclosure of which is incorporated by reference.

BACKGROUND

Technical Field of the Invention

The present disclosure relates generally to barriers (such as railings or fences) and in particular to a barrier panel utilizing cables as vertical barrier members.

Description of Related Art

It is common to form a barrier for railing or fence applications made, for example, of a plurality of panel members, with each panel member supported between and attached to a pair of post members. Each panel generally comprises a bottom rail extending between two posts and a top rail also extending between those same two posts. A plurality of vertical support members (also referred to in the art as pickets or balusters) extend between the bottom rail and the top rail. The bottom rail, top rail and vertical support members are made of a metal material (such as steel or aluminum). In an embodiment, first ends of the vertical support members are fixedly attached to the bottom rail (for example, through bolts, brackets or welding) and second ends of the vertical support members are fixedly attached to the top rail (again, for example, through bolts, brackets or welding).

The panel may be pre-assembled before delivery to a job site. In such a case, the installer may simply install the pair of posts with a separation substantially equal to a length of the panel. The installed posts should have an exposed height that is greater than a height of the panel. Brackets mounted on each post accept and retain ends of the bottom and top rails.

U.S. Pat. No. 10,883,290 to Fortress Iron, LP relates to a vertical cable rail panel with tension adjustable vertical cables and rigid support members, which is incorporated herein by reference. U.S. 2020/0080620 to Digger Specialties, Inc. relates to a rail system that employs tensioned cables to serve as physical barriers as an alternative to rigid only baluster railing systems. U.S. Publication No. 2006/0151760 to Vyvyan-Vivian relates to a tensioning system comprising one or more cable spacing members with cable spacing portions, and adjustable positional members for positioning the cable spacing members and adjusts the tension in the runs of cable. A vertical cable rail panel may be fabricated and assembled with different manufacturing processes according to the present disclosure in a manner that may result in certain efficiencies and improvements over conventional vertical rail panels.

SUMMARY

In an embodiment, a rail panel includes a top rail having a bottom wall, a top wall, and a pair of internal walls running a length of the top rail and extending toward the top wall. The top wall of the top rail defines a plurality of fastener receiving holes spaced apart along the length of the top rail, and the bottom wall of the top rail defines a plurality of top cable holes spaced apart along the length of the top rail, the fastener receiving holes are larger in size than the top cable holes. The rail panel includes a bottom rail having a top wall, a bottom wall, a first side wall, a second side wall disposed opposite the first side wall, and an internal wall running a length of the bottom rail and extending from the first side wall to the second side wall. The top wall of the bottom rail defines a plurality of bottom cable holes disposed spaced apart along the length of the top wall of the bottom rail, and the bottom wall of the bottom rail defines a plurality of clip receiving holes spaced apart along the length of the bottom wall of the bottom rail, the clip receiving holes are larger in size than the bottom cable hole. The rail panel includes a plurality of vertical cables extending from the top rail to the bottom rail, a top end of each the plurality of vertical cables extending through a respective top cable hole, and a bottom end of each of the plurality of vertical cables extending through a respective bottom cable hole. The rail panel includes a plurality of threaded swage fittings, each coupled to a respective top end of one of the plurality of vertical cables, each threaded swage received between the pair of internal walls of the top rail such that the pair of internal walls prevent rotation of the threaded swage fitting, each of plurality of threaded swage fittings and each of the top cable holes being sized to prevent the threaded swage fitting from passing through the top cable hole. The rail panel includes a plurality of clip receiving swage fittings, each coupled to a respective bottom end of one of the plurality of vertical cables and sized to pass through the bottom cable holes. The rail panel includes a plurality of clips, each received by a respective clip receiving swage fitting, each clip and each bottom cable hole sized to prevent the clip from passing through the bottom cable hole. The rail panel includes a rigid support member extending from the top rail to the bottom rail.

In another embodiment a rail panel includes a first rail having a bottom wall, a top wall, and a pair of internal walls running a length of the first rail and extending toward the top wall. The top wall of the first rail defines a plurality of fastener receiving holes spaced apart along the length of the first rail, and the bottom wall of the first rail defines a plurality of top cable holes spaced apart along the length of the first rail, the fastener receiving holes being larger in size than the top cable holes. The rail panel includes a second rail having a top wall, a bottom wall, a first side wall, a second side wall disposed opposite the first side wall, and an internal wall running a length of the second rail and extending from the first side wall to the second side wall. The top wall of the second rail defines a plurality of bottom cable holes disposed spaced apart along the length of the top wall of the second rail, and the bottom wall of the second rail defines a plurality of clip receiving holes spaced apart along the length of the bottom wall of the second rail, the clip receiving holes being larger in size than the bottom cable holes. The rail panel includes a plurality of vertical cables extending from the first rail to the second rail, a top end of each the plurality of vertical cables extending through a respective top cable hole, and a bottom end of each of the plurality of vertical cables extending through a respective bottom cable hole. The rail panel includes a plurality of threaded swage fittings, each coupled to a respective top end of one of the plurality of vertical cables, each threaded swage received between the pair of internal walls of the first rail such that the pair of internal walls prevent rotation of the threaded swage fitting, each of plurality of threaded swage fittings and each of the top cable holes being sized to prevent the threaded swage fitting from passing through the top cable hole. The rail panel includes a plurality of clip receiving swage fittings, each coupled to a respective bottom end of one of the plurality of vertical cables and sized to pass through the bottom cable holes. The rail panel includes a plurality of clips, each received by a respective clip receiving swage fitting, each clip and each bottom cable hole sized to prevent the clip from passing through the bottom cable hole. The rail panel includes a rigid support member extending from the first rail to the second rail.

In yet another embodiment, a rail panel includes a top rail having a bottom wall and a top wall, the top wall of the top rail defining a plurality of fastener receiving holes spaced apart along the length of the top rail, and the bottom wall of the top rail defining a plurality of top cable holes spaced apart along the length of the top rail. The rail panel includes a bottom rail having a top wall and a bottom wall, the top wall of the bottom rail defining a plurality of bottom cable holes disposed spaced apart along the length of the top wall of the bottom rail, and the bottom wall of the bottom rail defining a plurality of clip receiving holes spaced apart along the length of the bottom wall of the bottom rail. The rail panel includes a plurality of vertical cables extending from the top rail to the bottom rail, a top end of each the plurality of vertical cables extending through a respective top cable hole, and a bottom end of each of the plurality of vertical cables extending through a respective bottom cable hole. The rail panel includes a plurality of threaded swage fittings, each coupled to a respective top end of one of the plurality of vertical cables, a plurality of clip receiving swage fittings, each coupled to a respective bottom end of one of the plurality of vertical cables, and a plurality of clips, each received by a respective clip receiving swage fitting.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION

Figure 1A:
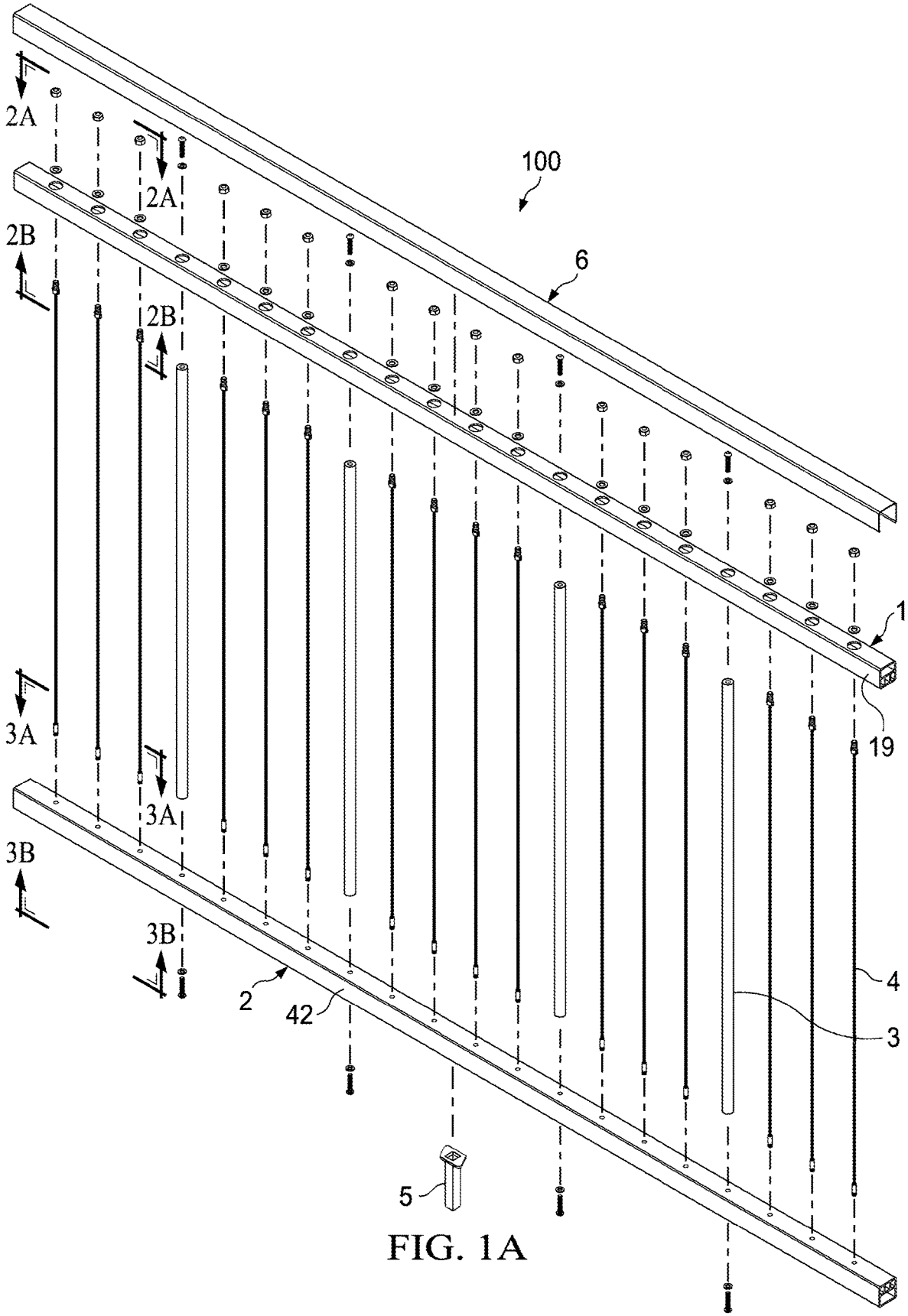
FIG. 1A is an exploded view of an embodiment of a vertical cable rail panel.
Figure 1B:
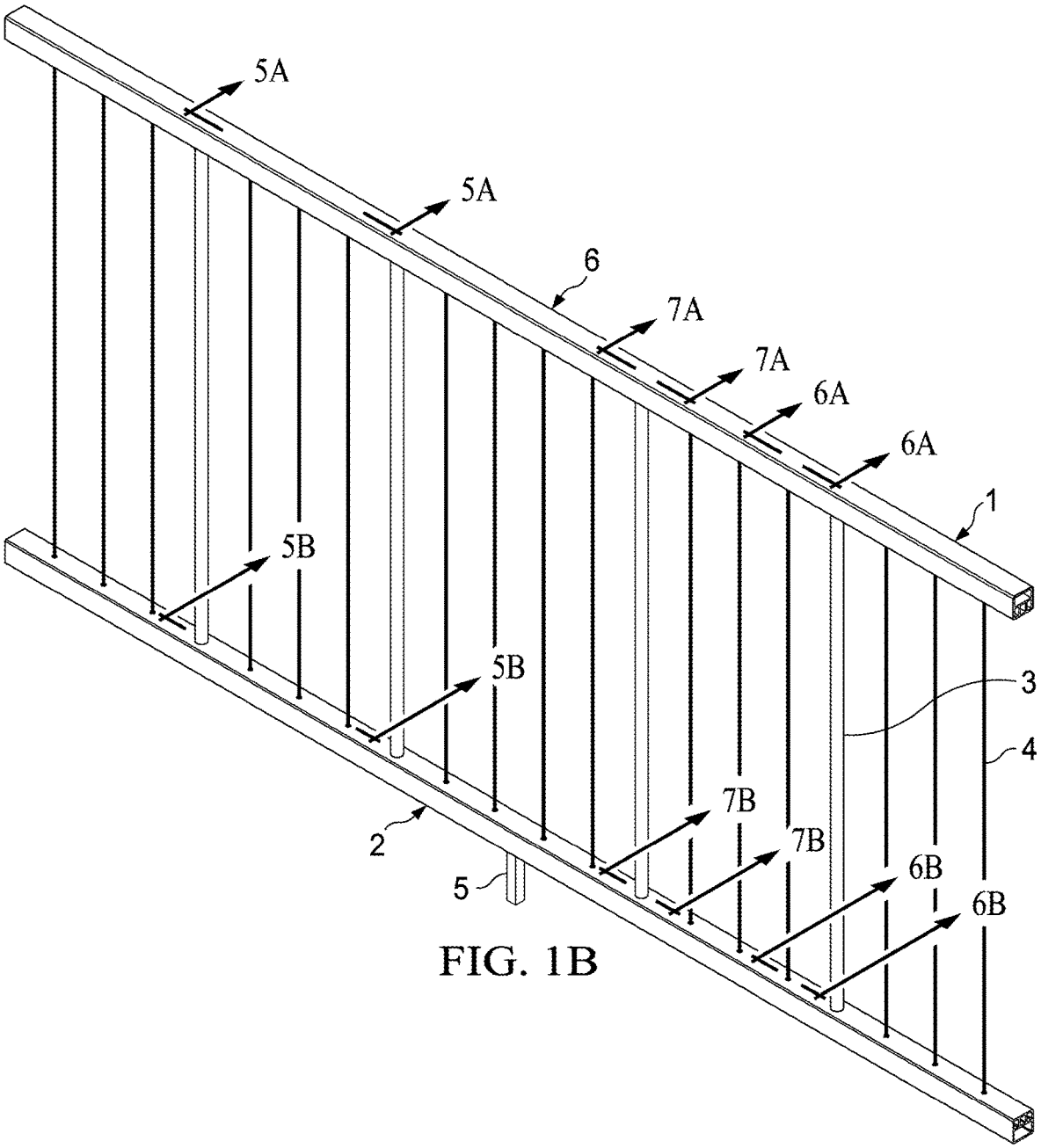
FIG. 1B is a perspective view of the vertical cable rail panel assembled according to the teachings of the present disclosure.

Reference is made to FIGS. 1A and 1B, which illustrate an exploded and a perspective view respectively of a vertical cable rail panel 100 with rails that have internal cable fitting engagement features according to the present disclosure. The vertical cable rail panel 100 includes a top rail 1 and a bottom rail 2. First ends of a pair of vertical support members (e.g. railing posts) (not shown) may be fixedly attached (for example, by bolts, welding or brackets) to the bottom rail 2. Second ends of the vertical support members may be fixedly attached (also, for example, by bolts, welding or brackets) to the top rail 1. Multiple panels supported by posts create a railing that may be positioned at a perimeter of an outdoor deck.

The vertical cable rail panel 100 also includes a plurality of rigid support members 3 and a plurality of vertical cables 4 disposed spaced apart along the length of the rails 1, 2. The top rail 1 and the bottom rail 2 are spaced apart by the rigid support members 3 (extending between the top and bottom rail). In an embodiment, the rigid support members 3 are hollow tubular members having a desired cross-section including, for example, square, rectangular, circular, hexagonal, octagonal, or the like. In either case, a threaded opening may be provided at each end of the rigid support member 3 to accept a mounting bolt for attachment of the rigid support member 3 to the top and bottom rails 1, 2. According to an embodiment, a threaded female fitting may be received by the rigid support member 3 to accept the mounting bolt (see FIG. 7A). The connection between the rigid support member 3 and the top and bottom rails 1, 2 is described further herein.

In an embodiment, each of the top and bottom rails 1, 2 are extruded. According to some embodiments, the rails 1, 2 are extruded from aluminum or other suitable metal. Extrusion allows certain features such as internal horizontal and vertical walls to be formed in the rails 1, 2. An extruded blank having a specific cross section along its entire length can be formed and features may be added through drilling or other post-extrusion manufacturing processes. The features of the top and bottom rails 1, 2 that are either formed by extrusion or formed by post-extrusion metal forming processes facilitate attachment of the cables 4 and the rigid support member 3, as described herein. The cables 4 and rigid support members 3 are easily installed, the cables 4 are easily tensioned, and the cables 4 can be removed easily from the assembly. Alternatively, either the top rail 1 or the bottom rail 2 or both may be formed by a suitable forming process for metal or polymeric material other than extrusion.

The vertical cable rail panel 100 includes a plurality of vertical cables 4 that are spaced apart along the length of the rails 1, 2. The vertical cables 4 are formed of metal, for example, stainless steel. The vertical cables 4 may be of a wound, woven or solid (rod) type as desired and is to some degree flexible along its length. The vertical cables 4 bend when a compressive force is applied, but hold a vertical orientation when appropriately tensioned. A separate support structure 5, which may be referred to as an I-support, may be used to oppose sagging that might occur in a vertical cable rail panel 100 with a significant length. The vertical cable rail panel 100 may also include a cover 6 for the top rail 1 to conceal the hardware that would otherwise be visible. The cover 6 is received over the upper wall 15 of the top rail 1 to conceal the holes and the hardware including the tensioning nuts 7 that would otherwise be visible without the cover 6. According to certain embodiments, the cover 6 may be a U-channel configured to clip (e.g., snap, mate, etc.) over the top rail 1.

In some embodiments, the cover 6 may be in the form of an accent top rail (ATR). According to this embodiment, a plurality of spacers may be spaced apart along the length of the top rail 1. The spacers may be generally U-shaped brackets shaped to wrap around the top rail 1. The spacers may be secured to the top rail using fasteners received through lateral holes in the spacer that penetrate the side wall of the top rail 1. The ATR is then coupled (e.g., snapped, clipped) to the top rail and engages with the spacers. The cover 6 or the ATR configuration may be used depending on the strength and/or aesthetic requirements of the given vertical cable rail panel 100.

Figure 2A:
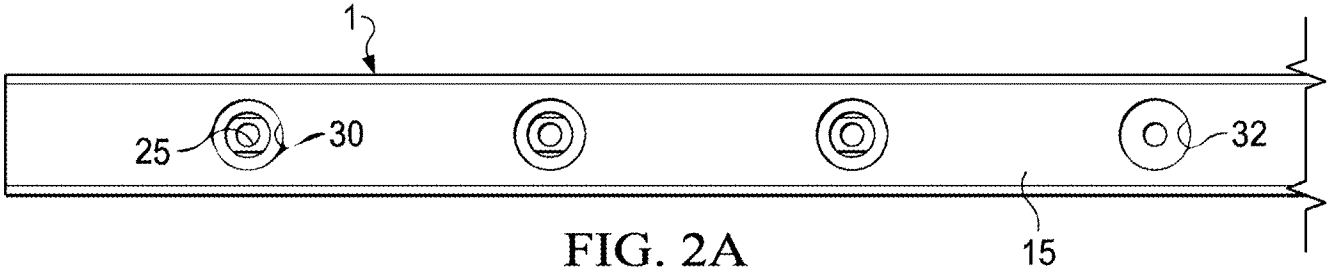
FIG. 2A is a top view of a portion of a top rail of the vertical cable rail panel.
Figure 2B:
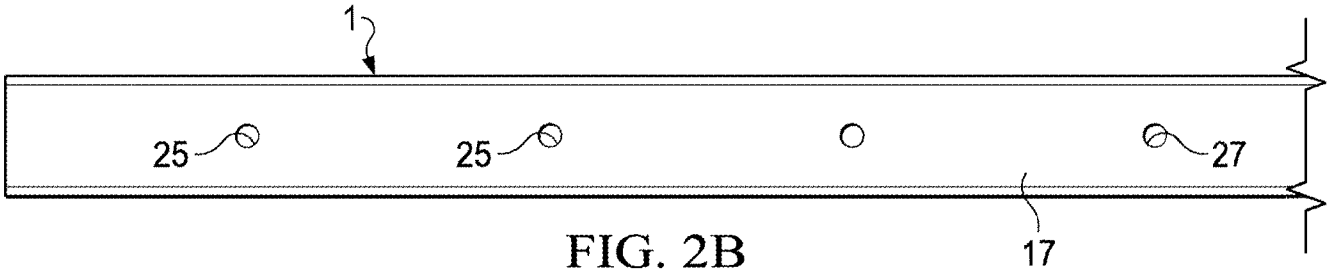
FIG. 2B is a bottom view of a portion of the top rail of the vertical cable rail panel.
Figure 4A:
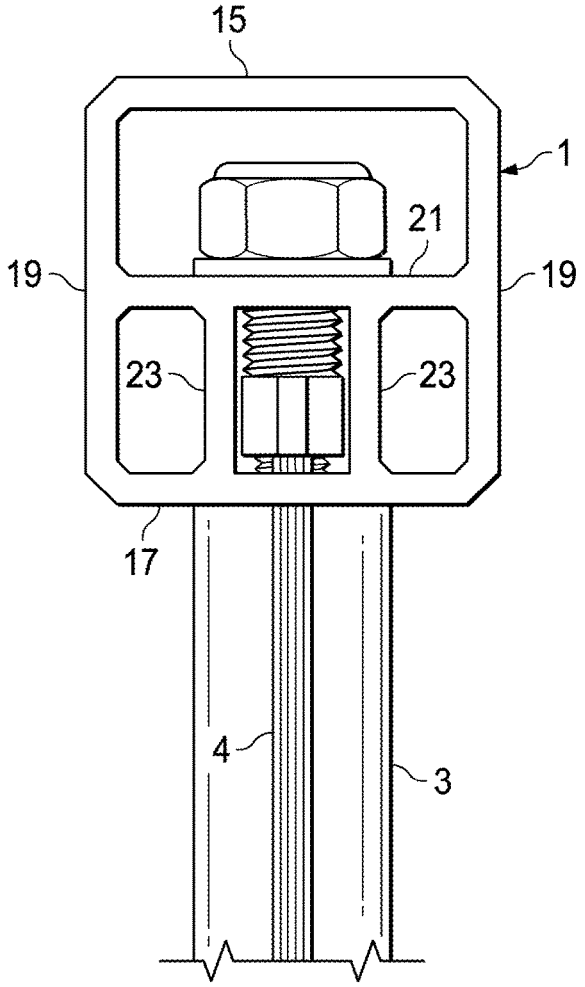
FIG. 4A is an end view of the top rail showing a vertical cable and a rigid support member.

Reference is made to FIGS. 2A and 2B, which illustrate views from above the top rail 1 and underneath the bottom of the top rail 1, respectively. An upper wall 15 of the top rail 1 includes a plurality of holes through the top surface. A lower wall 17 also includes a plurality of holes through the bottom surface. The top rail 1 may be an extruded metal body having a particular cross-section as shown in FIG. 4A. According to one embodiment, the top rail 1 includes the upper wall 15, the lower wall 17, and opposed side walls 19. The extrusion of the top rail 1 also includes internal walls. An internal horizontal wall 21 extends laterally from a first sidewall 19 to the second sidewall 19 and extends the length of the top rail 1. The top rail 1 also includes internal vertical walls 23 that extend from the lower wall 17 to the internal horizontal wall 21 and also extend the length of the top rail 1. The internal walls 21 and 23 support attachment of the cables 4 and the rigid support members 3, as described in more detail below. For instance, the space between the internal walls 23 receives a swage fitting (e.g., threaded fitting 60), as explained herein. As a nut engaged with the swage fitting is tightened to secure the cable 4 and the swage fitting to the top rail 1, the space between the internal walls 23 prevents the swage fitting 60 from rotating.

According to an alternate embodiment, the internal walls 21, 23 may be portions of a separate part that is coupled to the top rail 1 (or the bottom rail 2). As such, the internal walls 21, 23 of the top rail 1 (or the bottom rail) may be formed by a separate bar that is configured to slide into the top rail. The separate bar may engage the top rail 1 to form a feature similar internal horizontal wall. The separate bar may also include vertical extensions that function similar to the internal vertical walls 23 and are configured to engage flanges of the threaded cable fitting to prevent rotation upon tightening the tensioning nut. This disclosure contemplates any suitable shape of the top rail 1 or the bottom rail 2 that functions to capture the threaded swage fitting and prevent it from rotating in a manner that would interfere with tensioning the cable 4.

FIG. 2B is a detailed view of a portion of the lower wall 17 of the top rail 1. The lower wall 17 includes a plurality of cable holes 25 and a plurality of support member fastener holes 27. The cable holes 25 are small in diameter to allow the cable (and the clip receiving swage fitting, as described in more detail herein) to pass through and prevent the fittings that are larger than the cable 4 diameter from passing through cable holes 25. The cable holes 25 extend completely through the top rail 1 including through the internal horizontal wall 21 (see FIGS. 5A and 6A).

The support member fastener holes 27, according to certain embodiments, also extend completely through the top rail 1 including through the internal horizontal wall 21 and the upper wall 15. The support member fastener hole 27 receives a fastener that is received in an upper end of the rigid support member 3 (see FIGS. 5A and 6A).

A plurality fastener receiving holes 30 are formed in the upper wall 15 concentric and coaxial with the cable holes 25. The engagement of the cable 4 with the top rail 1 is shown in cross section along the longitudinal axis in FIG. 6A. The fastener receiving holes 30 only extend through the upper wall 15.

Figure 7A:
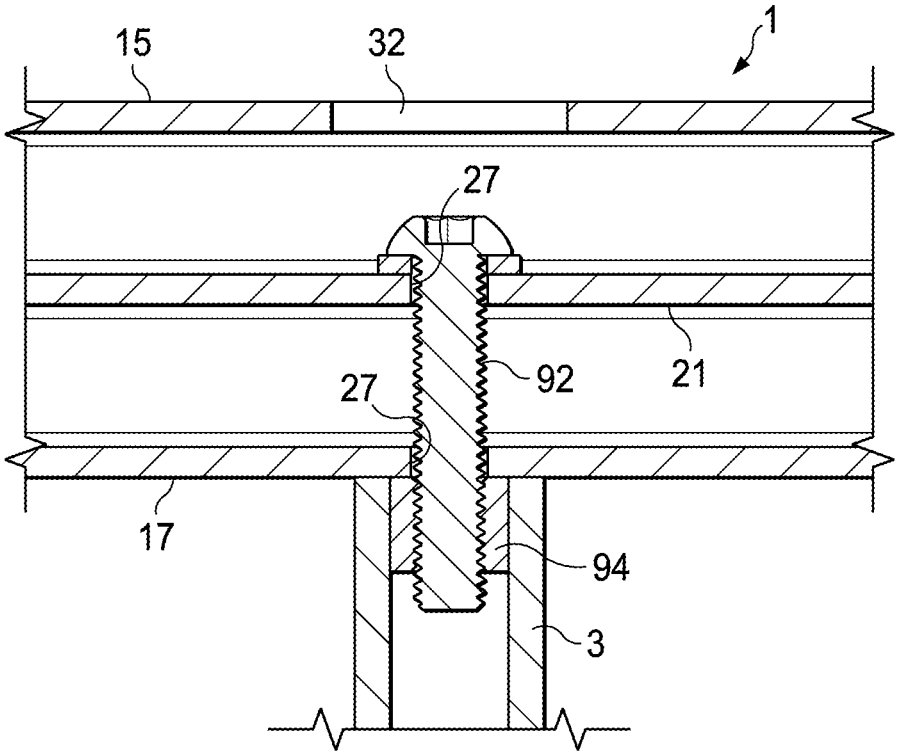
FIG. 7A is a detail view of the cross section of FIG. 5A showing the assembly of a rigid support member with the top rail.

The engagement of the rigid support member 3 and the top rail 1 is shown in cross section taken along the longitudinal axis of the top rail 1 in FIG. 7A. A plurality of support member fastener head receiving holes 32 are also formed in the upper wall 15. These holes have a larger diameter than the support member fastener holes 27 to receive the head of the fastener 92 and allow access to the fastener head with a suitable tool, such as a screw driver. The support member fastener head receiving holes 32 extend only through the upper wall 15 and are aligned with the support member fastener holes 27. Thus, the head of the fastener 92 is in engagement with the internal horizontal wall 21, and the shaft of the fastener extends through the support member fastener hole 27.

Figure 5A:
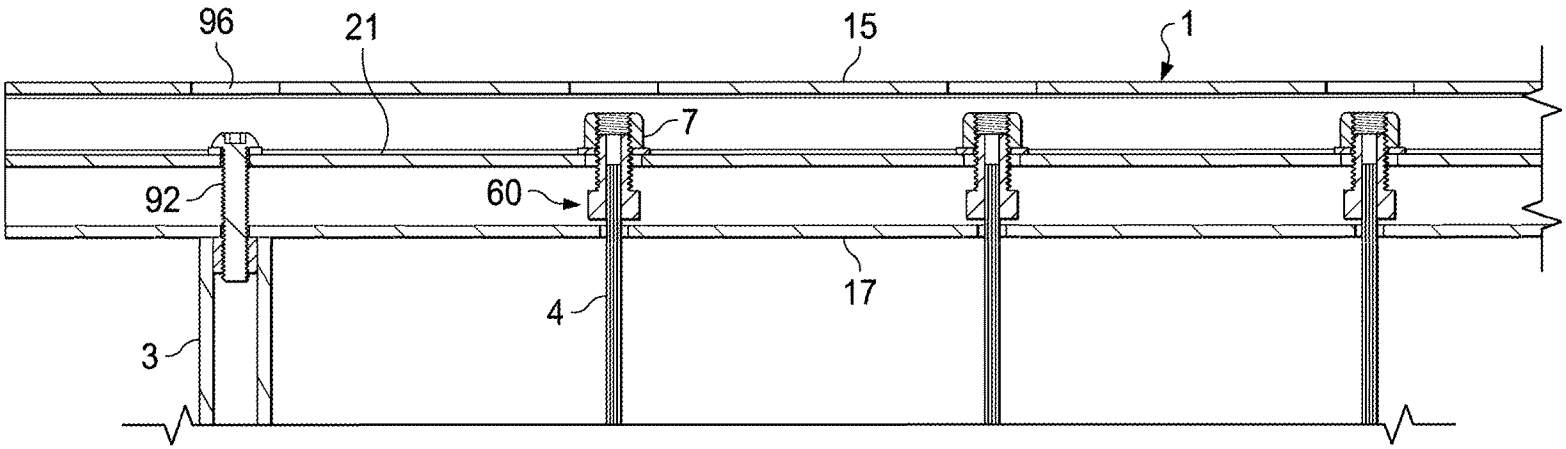
FIG. 5A is a longitudinal cross section of a portion of the top rail showing the assembly of the vertical cables and the rigid support member with the top rail.
Figure 5B:
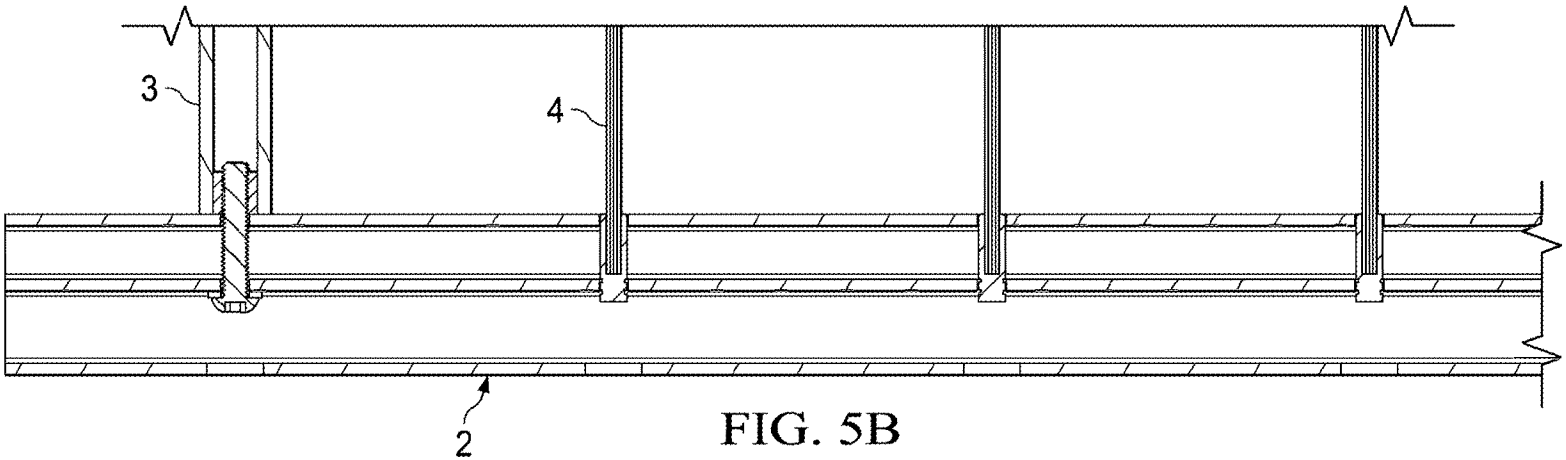
FIG. 5B is a longitudinal cross section of a portion of the bottom rail showing the assembly of the vertical cables and the rigid support member with the bottom rail.

As shown in FIGS. 5A and 7A, the upper end of the rigid support member 3 may be in confronting relation (e.g., abutting the lower wall 17) with the top rail 1. As such, the rigid support member 3 is configured to engage with the fastener 92 extending through the support member hole 27. The fastener 92 may be received in threaded engagement with a solid rigid support member 3 or the fastener may be received in threaded engagement with an insert that has been press fit into a tubular rigid support member 3.

Reference is made to FIGS. 3A, 3B, 4B, 5B, 6B, and 7B, which illustrate various views of a bottom rail 2 and the engagement of the bottom rail 2 with the cable fitting and the bottom rail 2 with the rigid support member 3. The bottom rail 2 includes an upper wall 40 and two sidewalls 42. A plurality of bottom support member fastener holes 44 are spaced apart along the upper wall 40. A plurality of bottom cable holes 46 are also spaced apart along the length of the upper wall 40 of the bottom rail 2. The holes described herein may have any desired shape (e.g., circular, rectangular, oblong, etc.) provided they are sized to function as described and illustrated.

Figure 7B:
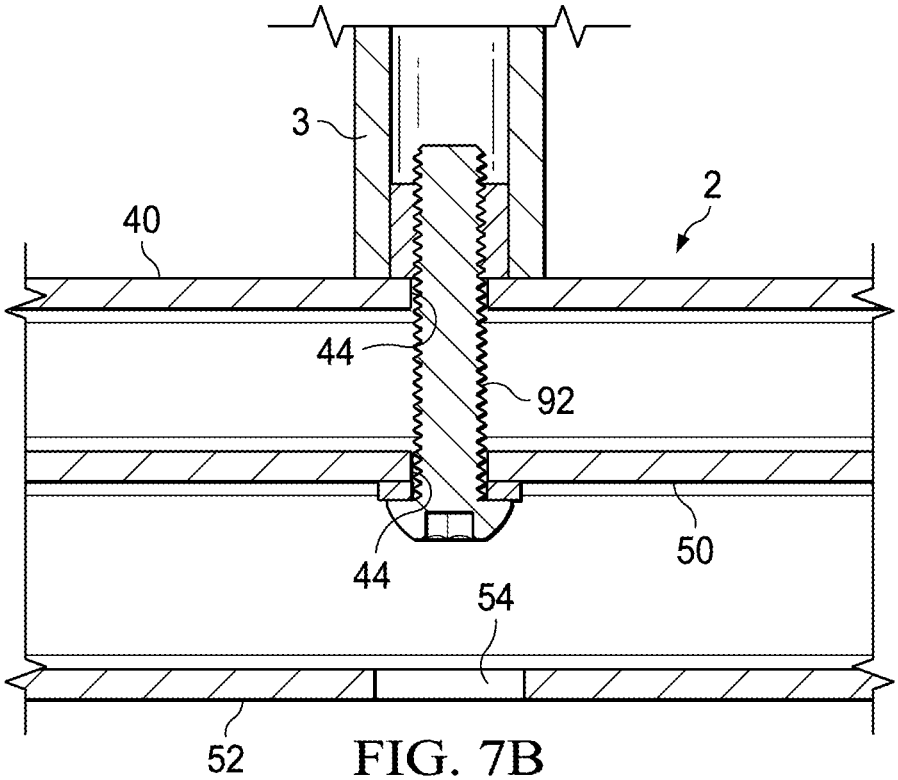
FIG. 7B is a detail view of the cross section of FIG. 5B showing the assembly of the rigid support member with the bottom rail.

The bottom support member fastener holes 44 extend completely through the bottom rail 2 including through the internal horizontal wall 50. A bottom end of the rigid support member 3 is disposed in abutting engagement with the upper wall 40 of the bottom rail 2, as shown in FIG. 7B. A fastener 92 is received through the support member fastener hole 44 and secures the rigid support member 3 in threaded engagement with the bottom rail 2. The hole 54 is larger in size than the hole 44 to allow the head of the fastener to pass through the bottom wall 52. Thus, the rigid support member 3 is secured between the top rail 1 and the bottom rail 2.

The bottom cable holes 46 extend completely through the bottom rail 2. The bottom cable holes 46 are large enough to allow the cable 4 and the clip receiving swage fitting 70 to pass through, but they restrict the clip 80 that is received through the hole 54 in the lower wall 52 and secured to the clip receiving swage fitting 70 from passing through the bottom cable holes 46.

Figure 3A:
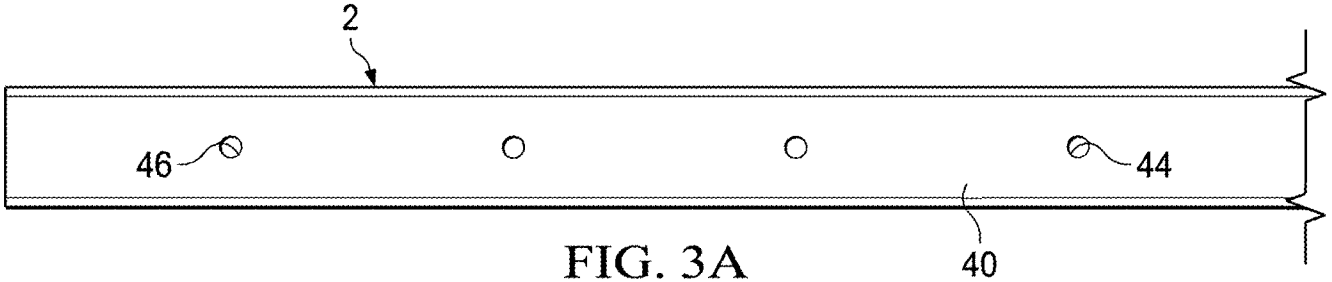
FIG. 3A is a top view of a portion of a bottom rail of the vertical cable rail panel.
Figure 3B:
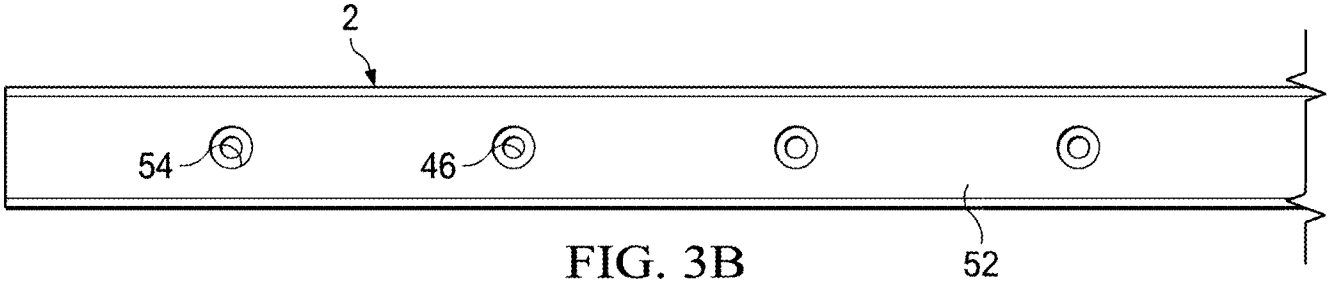
FIG. 3B is a bottom view of a portion of a bottom rail of the vertical cable rail panel.
Figure 4B:
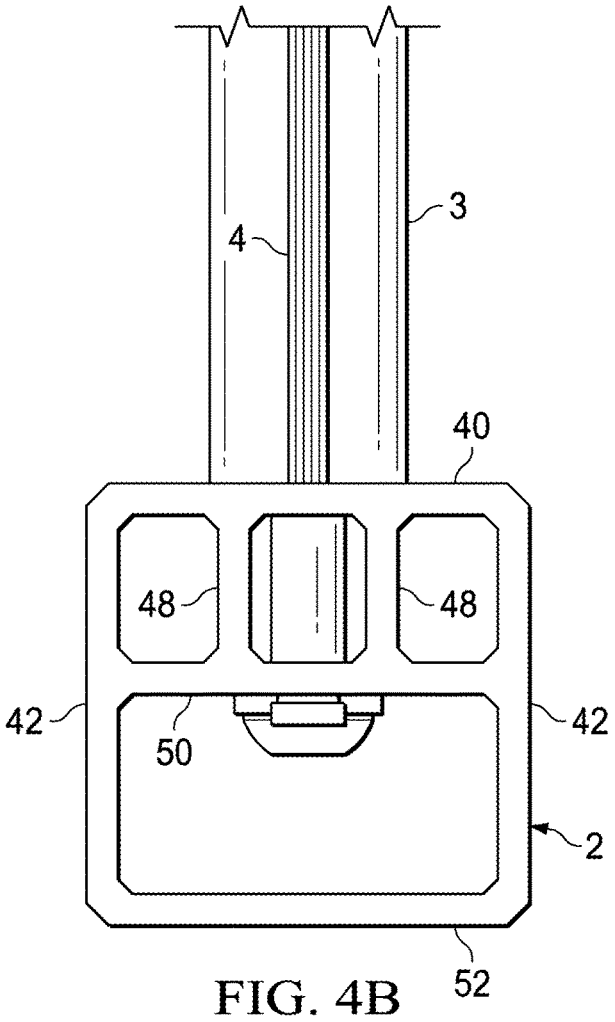
FIG. 4B is an end view of the bottom rail showing a vertical cable and a rigid support member.

FIG. 3B illustrates a detailed view of the lower wall 52 of the bottom rail 2. FIG. 6B shows the relationship between the bottom cable hole 46 and the clip receiving hole 54 in cross-section. FIG. 4B shows and end view of the bottom rail 2 to illustrate the engagement of the cable 4 with the bottom rail 2. A clip receiving hole 54 is formed through the lower wall 52, and the depth of the clip receiving hole 54 does not extend past the internal horizontal wall 50. The clip receiving hole 54 may have any desired shape (e.g., circular, rectangular, etc.), but in a preferred implementation the openings have circular shape. The clip receiving hole 54 is coaxial with the bottom cable hole 46. The clip receiving hole 54 is larger than the bottom cable hole 46. The bottom cable hole 46 extends through the internal horizontal wall 50. The hole in the internal horizontal wall 50 is the same diameter as the bottom cable hole 46. The clip receiving hole 54 allows the clip 80 to be received through the clip receiving hole 54 to secure the cable 4 between the top rail 1 and the bottom rail 2.

Generally, the rail profiles of the top rail 1 and the bottom rail 2 can be the same. That is, they may be formed of an extruded blank having the same shape in cross section. However, the extruded blank that becomes the top rail 1 and the extruded blank that becomes the bottom rail may be fabricated differently post-extrusion in order to be configured to receive the various components (e.g., the cable 4, the rigid support member 3, and the various fittings as described herein).

Figure 6A:
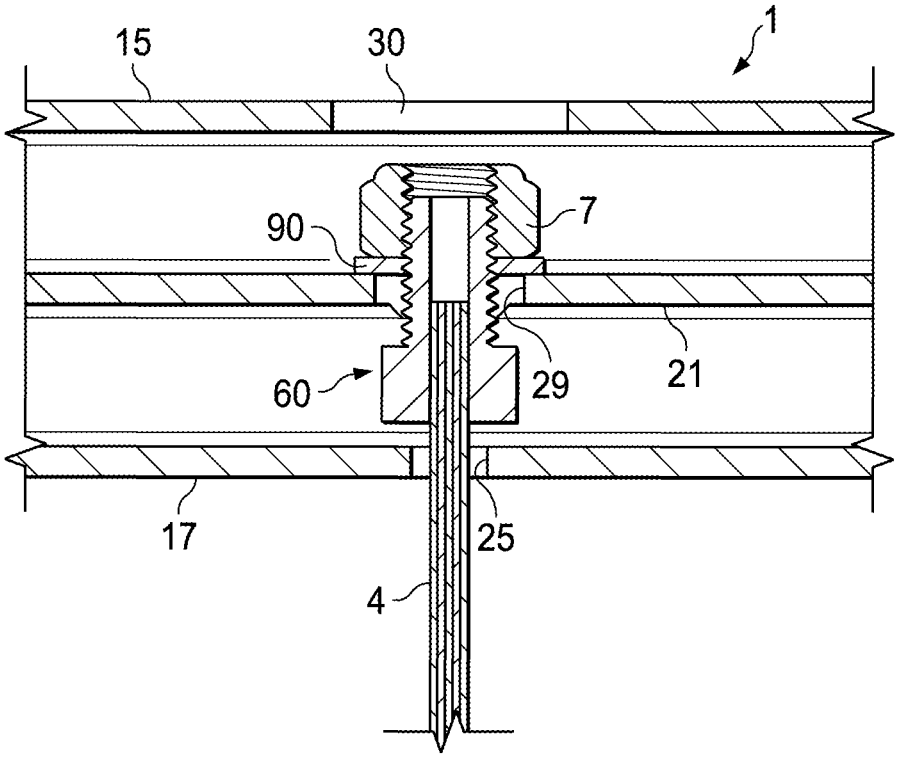
FIG. 6A is a detail view of the cross section of FIG. 5A showing the assembly of a vertical cable with the top rail.
Figure 6B:
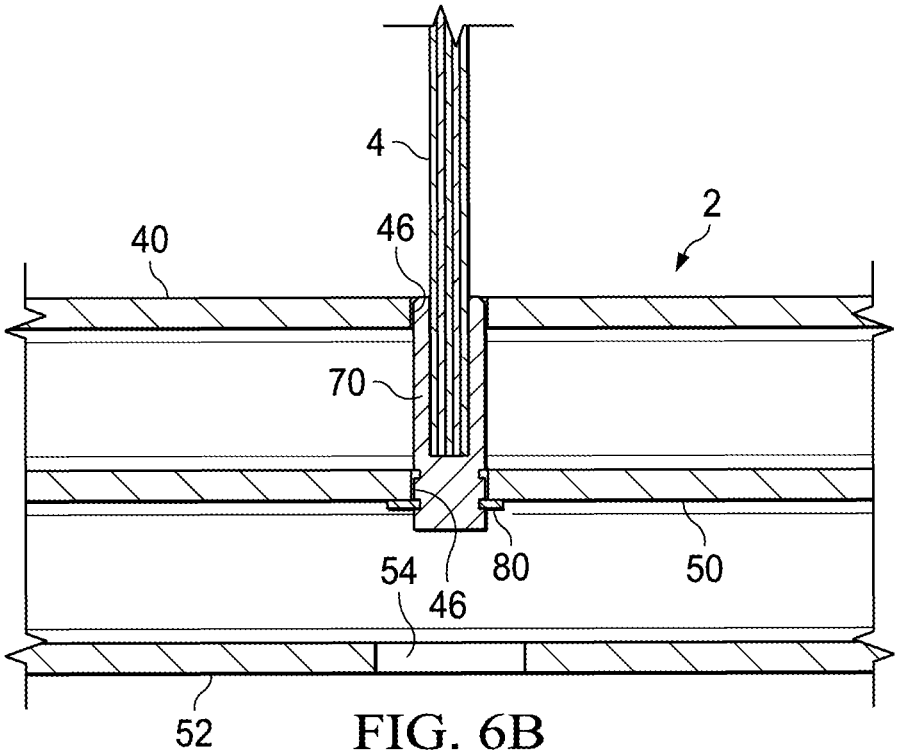
FIG. 6B is a detail view of the cross section of FIG. 5B showing the assembly of the vertical cable with the bottom rail.
Figure 8:
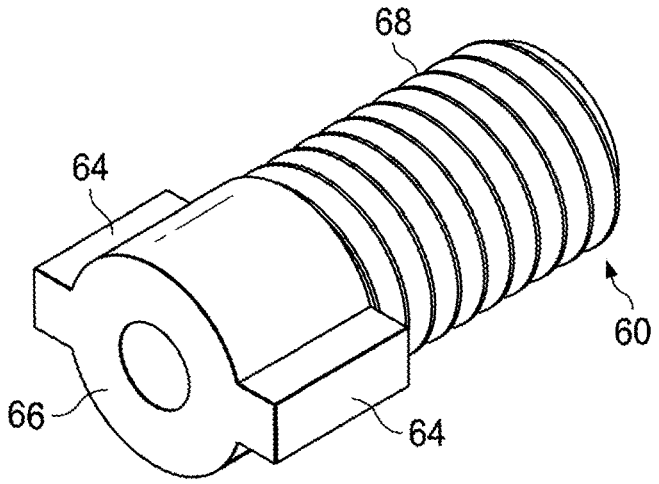
FIG. 8 is a perspective view of a threaded swage fitting.

FIG. 6A shows a cross-section of a threaded fitting 60 that is swaged to an end of the cable 4. FIG. 8 is a perspective view of the threaded fitting 60 with a borehole that receives the end of the cable 4. The cable 4 is received through the borehole, and the threaded fitting 60 is deformed to clamp onto the cable 4, as is known in the art. A pair of flanges 64 extend from a body 66 from the threaded fitting 60. The flanges 64 are received between the internal vertical walls 23 of the top rail 1. The internal vertical walls 23 prevent rotation of the threaded fitting 60 when a tensioning nut 7, or any suitable threaded fastener, is threaded to the threads 68. Thus, the tensioning nut 7 can be turned to tension the cables 4 without the threaded fitting 60 and the cable 4 rotating.

Figure 9:
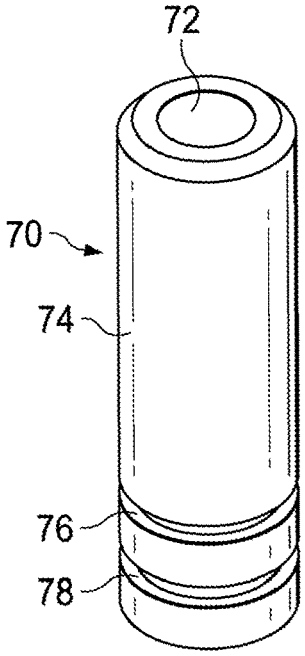
FIG. 9 is a perspective view of a clip receiving swage fitting.
Figure 10:
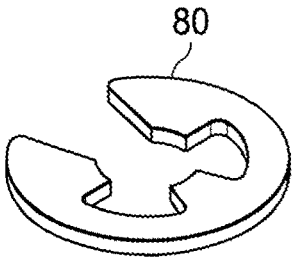
FIG. 10 is a perspective view of the clip.
Figure 11:
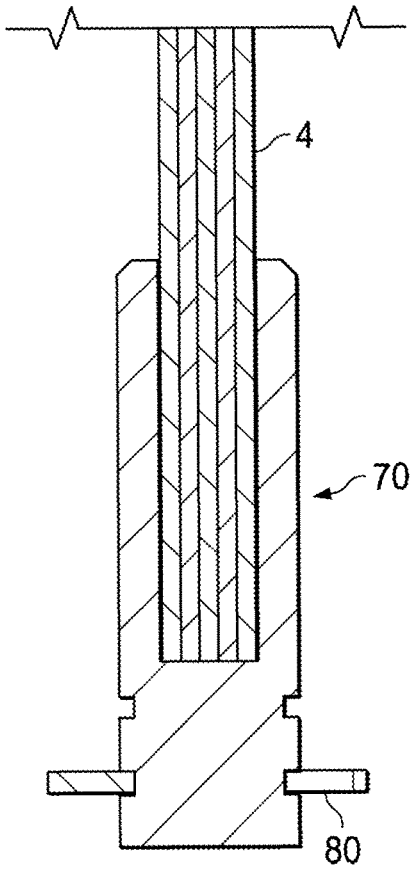
FIG. 11 is a cross-section view of the clip receiving swage fitting assembled with the cable and the clip.

FIGS. 6B and 11 show a cross section of a clip receiving swage fitting 70. FIG. 9 is a perspective view of the clip receiving swage fitting 70. A borehole 72 extends through the clip receiving swage fitting 70. According to certain embodiments, the borehole 72 is a through hole that extends completely through the clip receiving swage fitting 70. An upper annular recess 76 is formed in the body 74. A lower annular recess 78 is also formed in the body 74. The end of the cable 4 is received through the borehole 72, and a body 74 of the clip receiving swage fitting 70 is deformed to clamp onto the end of the cable 4, as is known in the art. The upper annular recess 76 serves to isolate a lower annular recess 78 from possible deformation that may occur when the body 74 is deformed to clamp the clip receiving swage fitting 70 to the cable 4. In this manner, swaging of the fitting 70 to the cable will not deform the lower annular recess 78. A non-deformed lower annular recess 78 will reliably receive the clip 80 that holds the lower end of the cable 4 to the lower rail 2.

The clip receiving swage fitting 70 that is secured to the end of the vertical cable 4 is received through the bottom cable hole 46 in the bottom rail 2 and the clip 80 is then clipped to the lower annular recess 78. The clip 80 is restricted from being drawn through the bottom cable hole 46 by the internal horizontal wall 50 of the bottom rail 2.

The cable 4 and the threaded fitting 60 are received through the fastener receiving holes 30. The flange portion 64 of the threaded fitting 60 is captured between the internal vertical walls 23. The tensioning nut 7 is threaded to the threaded fitting 60, and a washer 90 is compressed between the tensioning nut 7 and the internal horizontal wall 21. The cable hole 25 allows the cable 4 to extend therethrough, but it is not large enough for the threaded fitting 60 to pass through. The fastener receiving holes 30 are sized to receive the cable 4 and the threaded fitting 60 from the top wall 15 of the top rail 1. The cable 4 and the threaded fitting 60 are then captured, or positioned, via the tensioning nut 7.

FIG. 7A is a cross-section of the top rail 1 showing a connection of the rigid support member 3 with the top rail 1. An insert 94 having a threaded bore may be press fit or otherwise secured within a hollow rigid support member 3. A screw 92 or other fastener may be received through the hole 32 formed in the upper wall 15. A shaft of the fastener 92 extends through a hole 27 in the internal horizontal wall 21 and is in threaded engagement with the insert 94. Engagement of the screw with the threaded insert secures an upper end of the rigid support member 3 to the top rail 1.

The cable 4 is secured by swaging the clip receiving swage fitting 70 to the cable 4. Again, this swaging process may be completed prior to feeding the cable 4 through the rails 1, 2. The clip receiving swage fitting 70 extends through the upper wall 40 and the internal wall 50. The clip 80 is received through the bottom clip receiving hole 54 and clipped around the clip receiving swage fitting 70. The clip 80 maintains the cable 4 secured to the bottom rail 2. Tightening the tensioning nut 7 will increase tension the cable 4 because the clip 80 will apply an opposing force to the internal horizontal wall 50.

FIG. 7B is a cross-section of the bottom rail 2 taken at a location where the rigid support member 3 is connected to the bottom rail 2. The rigid support member 3 is abutted against the upper wall 40. Similar to the top rail, a fastener is received through the hole 54 and the hole 44 and in threaded engagement with an insert that has been press fit or otherwise secured within the hollow cavity of the rigid support member 3.

Figure 12:
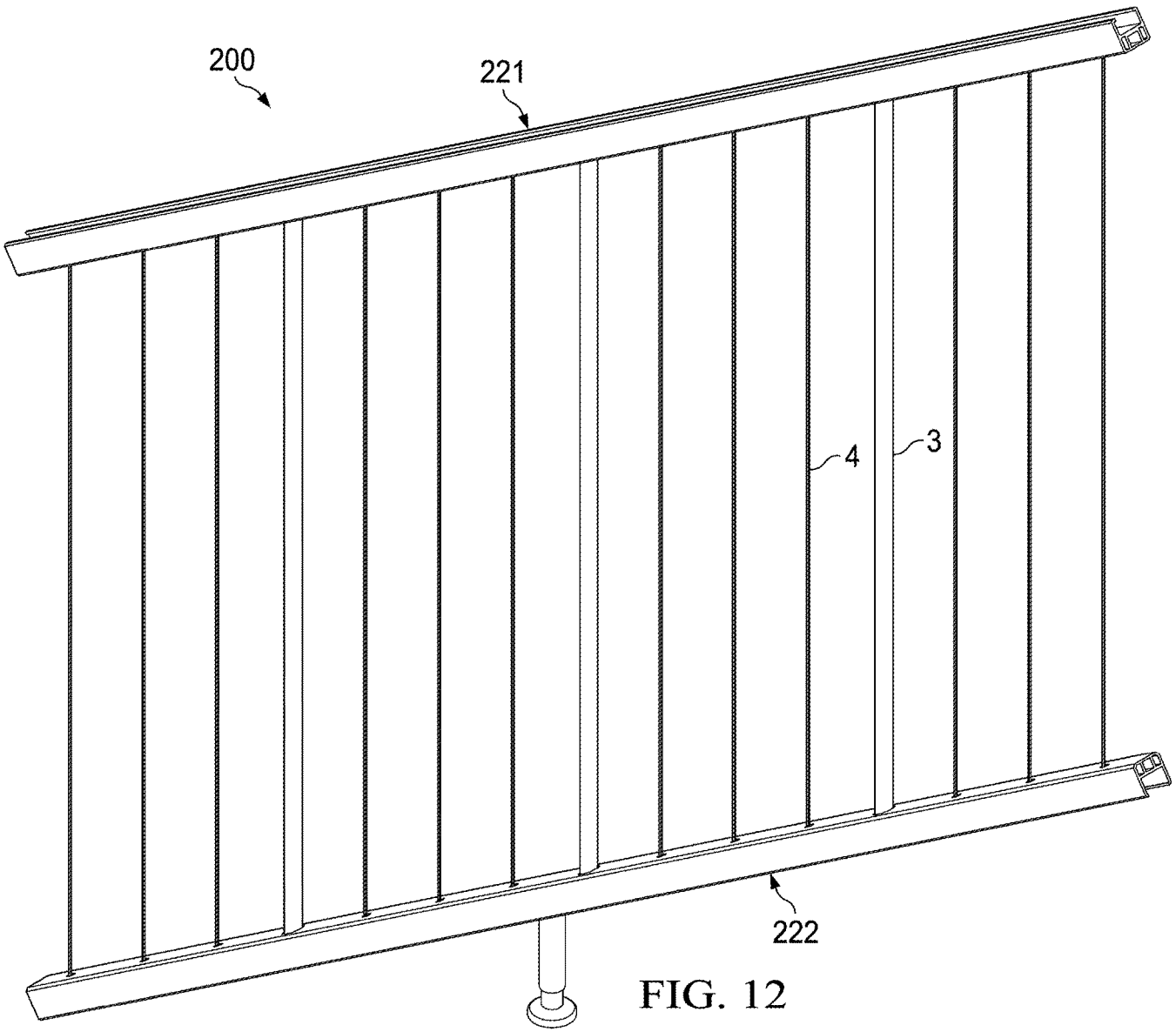
FIG. 12 is a perspective view of and embodiment of a vertical cable rail barrier according to the teachings of the present disclosure at an angle to accommodate stairs or sloped terrain.

FIGS. 12-21B illustrate features of an angled vertical cable rail panel 200. The angled vertical cable rail panel 200 may be used as railing for stairs and sloping or inclined terrain. The vertical cable rail panel 200 includes a top rail 221 and a bottom rail 222 that are inclined to follow the slope of the stairs or inclined terrain, as shown in FIG. 12. A separate support structure may be employed to oppose sagging the might occur in an angled vertical cable rail panel 200 with a significant length. The vertical cables 4 and the rigid support members 4 are disposed in vertical orientation. Accordingly, the cables 4 and the rigid support members 3 are disposed at a non-perpendicular angle with the top rail 222 and the bottom rail 221. According to certain embodiments, the top and bottom rails 221, 222 form approximately a 34° angle with the vertical cables 4. The top rail 221 may include features similar to those described above with respect to the top rail 1. The bottom rail 222 may include features similar to those described above with respect to the bottom rail 2. In order to maintain the non-perpendicular angle between the rails 221, 222 and the cables 4 and the rigid support members 3, certain inserts are applied at the junction of the cables 4 and the rails 221, 222 and at the junction of the rigid support member 3 and the rails 221, 222.

Figure 13A:
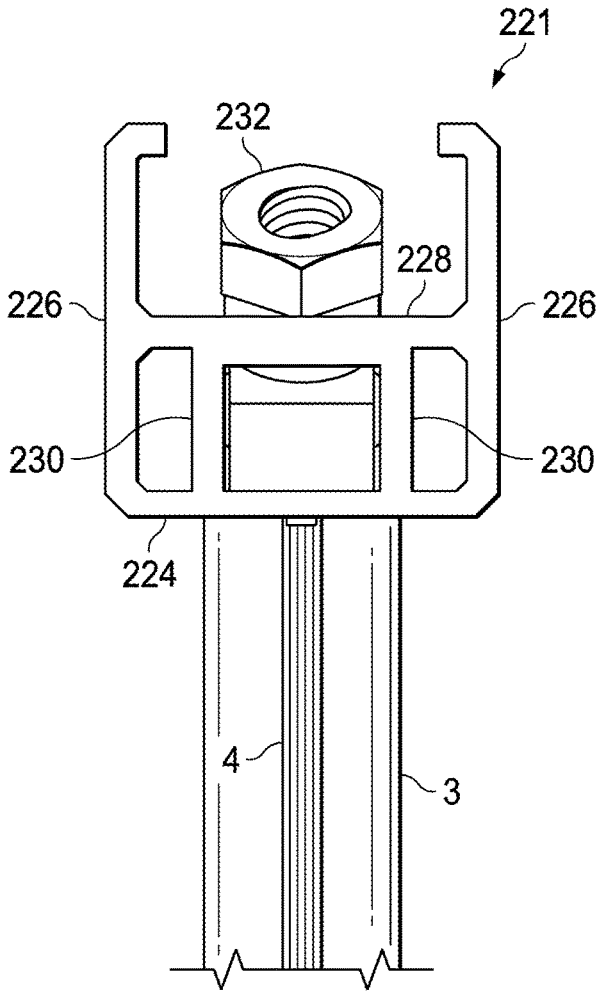
FIG. 13A is an end view of the top rail of the angled vertical cable panel.
Figure 13B:
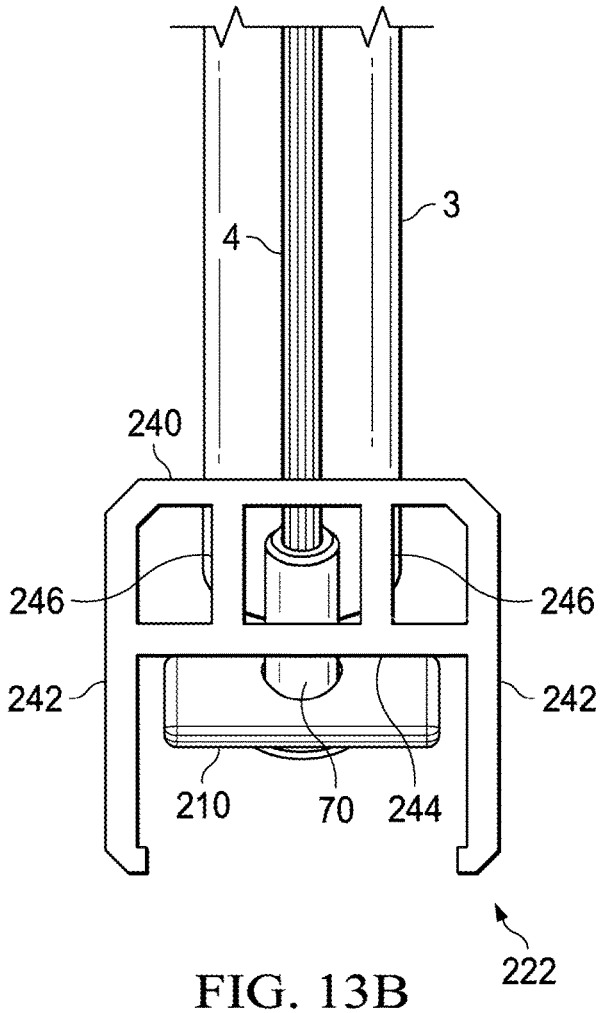
FIG. 13B is an end view of the bottom rail of the angled vertical cable panel.
Figure 21A:
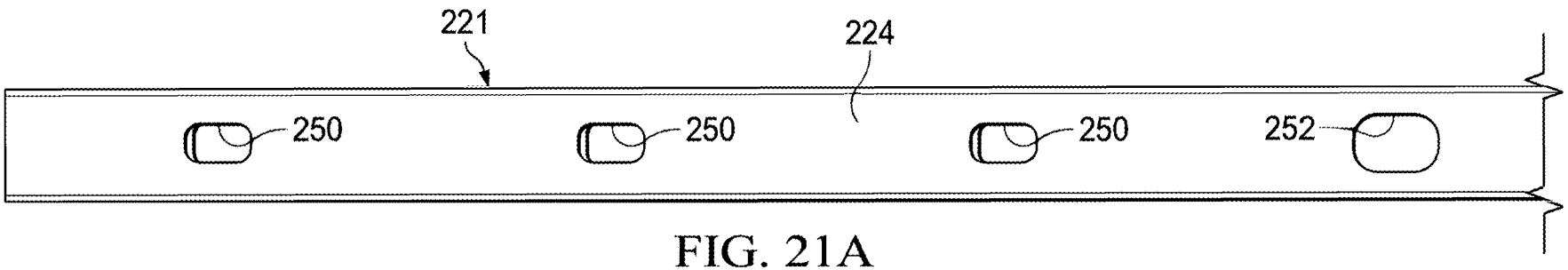
FIG. 21A is a view of a bottom side of the top rail of the angled vertical cable rail panel.

FIG. 13A is an end view of the top rail 221, and FIG. 13B is an end view of the bottom rail 222. The top rail 221 may be an extruded aluminum (or other suitable material) member with the cross sectional shape illustrated. The extruded aluminum blank may be further formed to add through holes, as shown in FIG. 21A. The top rail 221 includes a lower wall 224 and a pair of side walls 226 extending from the lower wall 224. A pair of internal vertical walls 230 extend from the lower wall 224 to an internal horizontal wall 228. A top wall may be omitted, such that the hardware joining the cable 4 and the rigid support member 3 may be received through an opening between the side walls 226. A cover may be snap fit over the top rail 221 to conceal this hardware that includes a plurality of tensioning nuts 232. According to an alternate embodiment, the top rail 221 may include a top wall similar to that illustrated and described with respect to top rail 1.

FIG. 21A illustrates the lower wall 224 of the top rail. A plurality of cable receiving holes 250 and a plurality of rigid support member receiving holes 252 are disposed along the length of the top rail 221. Each of the holes 250 and 252 may be an elongated circular shape to permit the cable 4 and the rigid support member to be received at a non-perpendicular angle with the top rail 221.

Figure 21B:
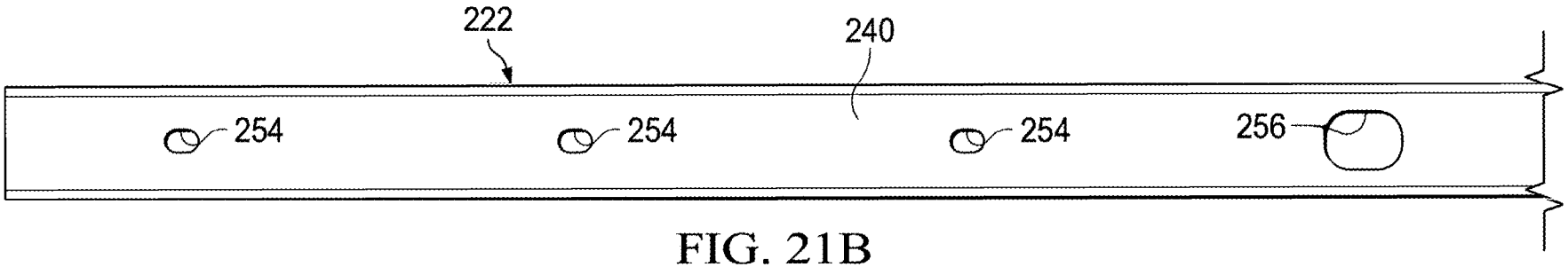
FIG. 21B is a view of a top side of the bottom rail of the angled vertical cable rail panel

As illustrated in FIG. 13B, the bottom rail 222 includes an upper wall 240 and a pair of side walls 242 extending from the upper wall 240. A pair of internal vertical walls 246 extend from the upper wall 240 to an internal horizontal wall 244. The bottom rail 222 may be an extruded aluminum (or other suitable material) member with the cross sectional shape illustrated. The extruded aluminum blank may be further formed to add through holes, as shown in FIG. 21B. Similar to the top rail 221, the bottom rail 222 may omit a lower wall and the hardware, such as the cam insert and the clip receiving swage fitting 70, may be received in an opening between the side walls 242.

FIG. 21B illustrates the upper wall 240 of the bottom rail 222. A plurality of cable receiving holes 254 and a plurality of rigid support member receiving holes 256 are disposed along the length of the bottom rail. Each of the holes 254, 256 may be an elongated circular shape to permit the cable 4 and the rigid support member 3 to be received at a non-perpendicular angle with the bottom rail 222.

Figure 14:
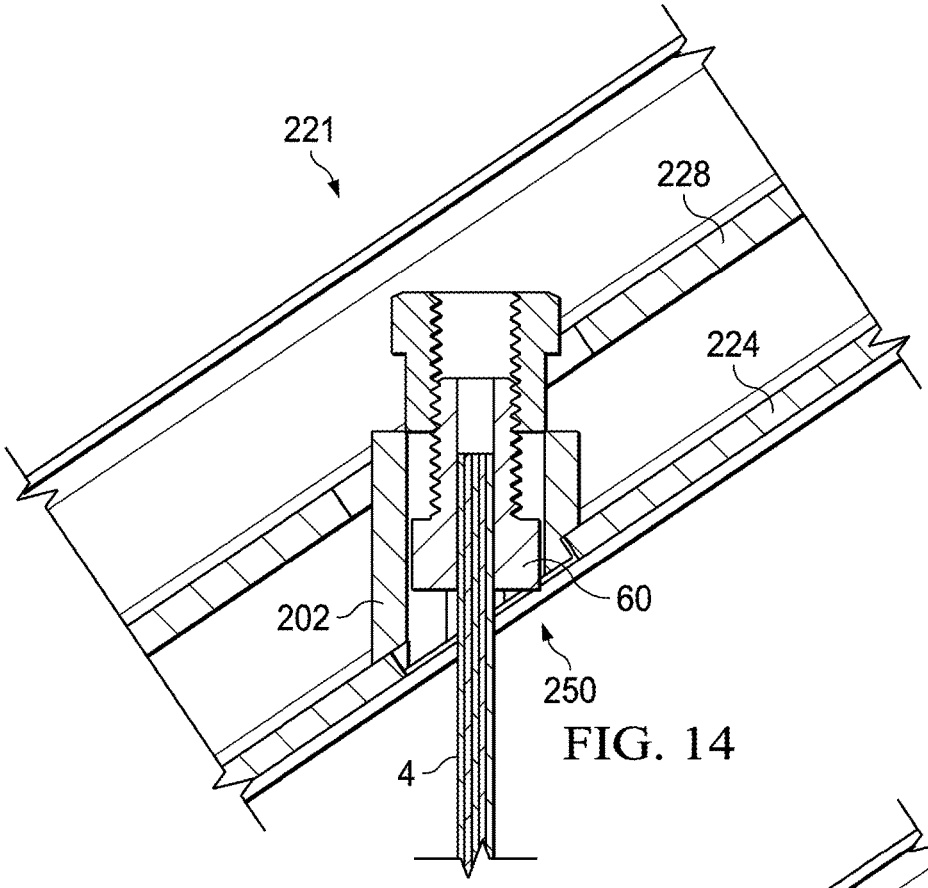
FIG. 14 is a cross-section view of the top rail at a location where the cable is joined to the top rail.
Figure 19:
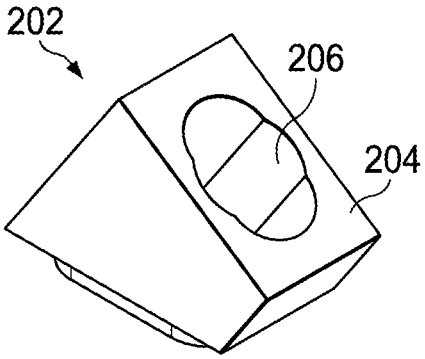
FIG. 19 is a perspective view of an angled insert.
Figure 20:
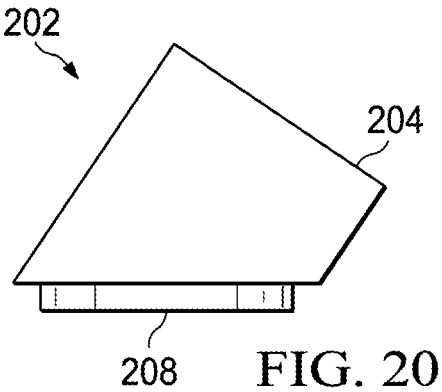
FIG. 20 is a side view of the angled insert.

FIG. 14 is a cross-section of the top rail 221 taken along the longitudinal axis of the top rail 221 at a location where the cable 4 is joined to the top rail 221. FIGS. 19 and 20 illustrate an angled insert 202. The angled insert 202 includes a face 204 that is disposed at a 34° angle with a base 208. The base 208 is received by the top rail 221 and seated. The threaded fitting 60 including the flanges 64 of the threaded fitting 60 are received by a borehole 206 formed in the angled insert 202. An axis of the borehole 206 forms an approximately 34 degree angle with the base 208. The borehole 206 is sized and shaped to receive the threaded fitting 60 and prevent the threaded fitting 60 and the cable 4 from rotating when the tensioning nut 7 is tightened on the threads of the threaded fitting 60 to increase tension the cable 4. The angled insert 202 maintains the cable 4 at approximately a 34° angle with respect to the top rail 1. The angled insert may be formed with the face 204 forming any suitable angle with the base 208. For example, an angle in the range of 25 degrees to 45 degrees is contemplated by this disclosure.

Figure 16:
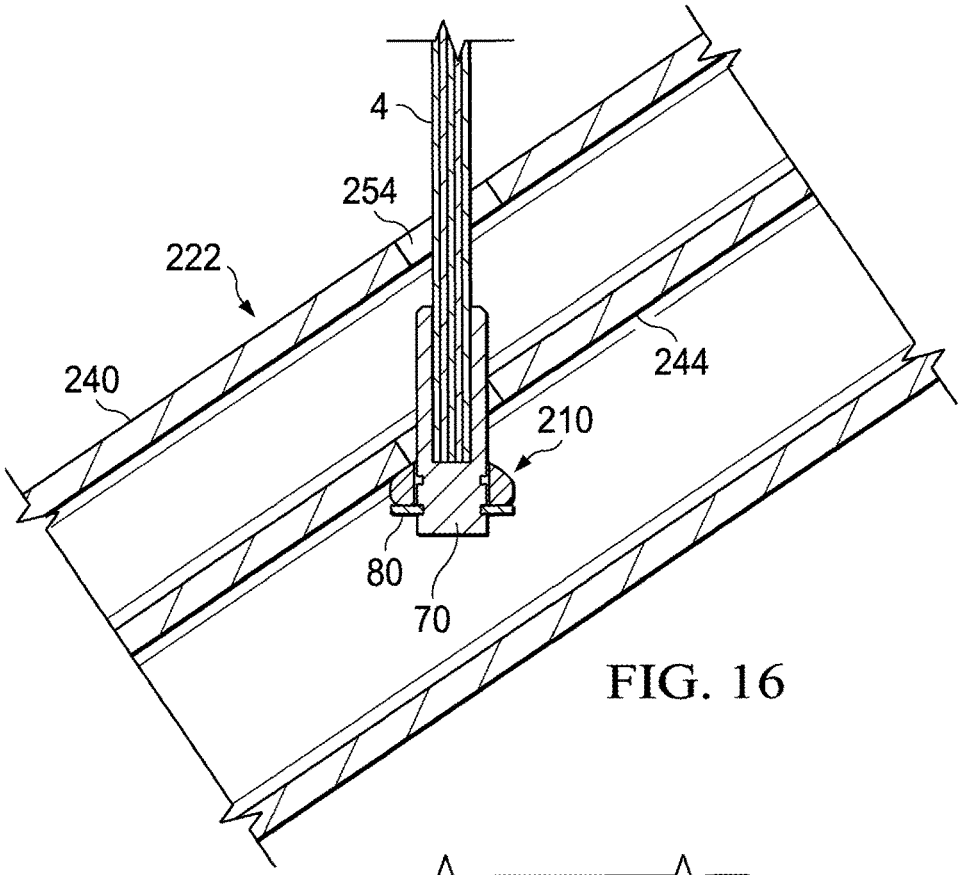
FIG. 16 is a cross-section view of the bottom rail at a location where the cable is joined to the bottom rail.
Figure 18:
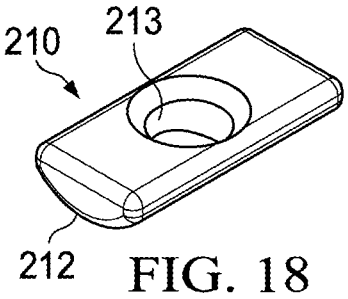
FIG. 18 is a perspective view of a cam insert.

FIG. 16 illustrates a cross-section of the junction of the bottom rail 222 and the cable 4 taken along a longitudinal axis of the bottom rail 222. FIG. 18 is a perspective view of a cam insert 210 that facilitates joining the cable 4 with bottom rail 222 at the 34° angle. The cam insert 210 includes an arcuate surface 212 that contacts the inner horizontal wall 244 of the bottom rail 222. The cam insert 210 also includes a through hole 213 through which the cable 4 and the clip receiving swage fitting 70 may pass. The clip 80 holds the cam insert 210 in place by contacting the cam insert 210 and thereby preventing the cable 4 and the clip receiving swage fitting 70 from being drawn through the through hole 213 in the cam insert 210 and the hole in the internal horizontal wall 244 in the bottom rail 222. In this manner, the cable 4 can be reliably secured to the bottom rail 222 at an angle, for example a 34° angle. The arcuate surface 212 of the cam insert 210 allows the cam insert 210 to be used in a range of angles between the cable 4 and the bottom rail 222, for example the angle may be between 25 degrees to 45 degrees.

Figure 15:
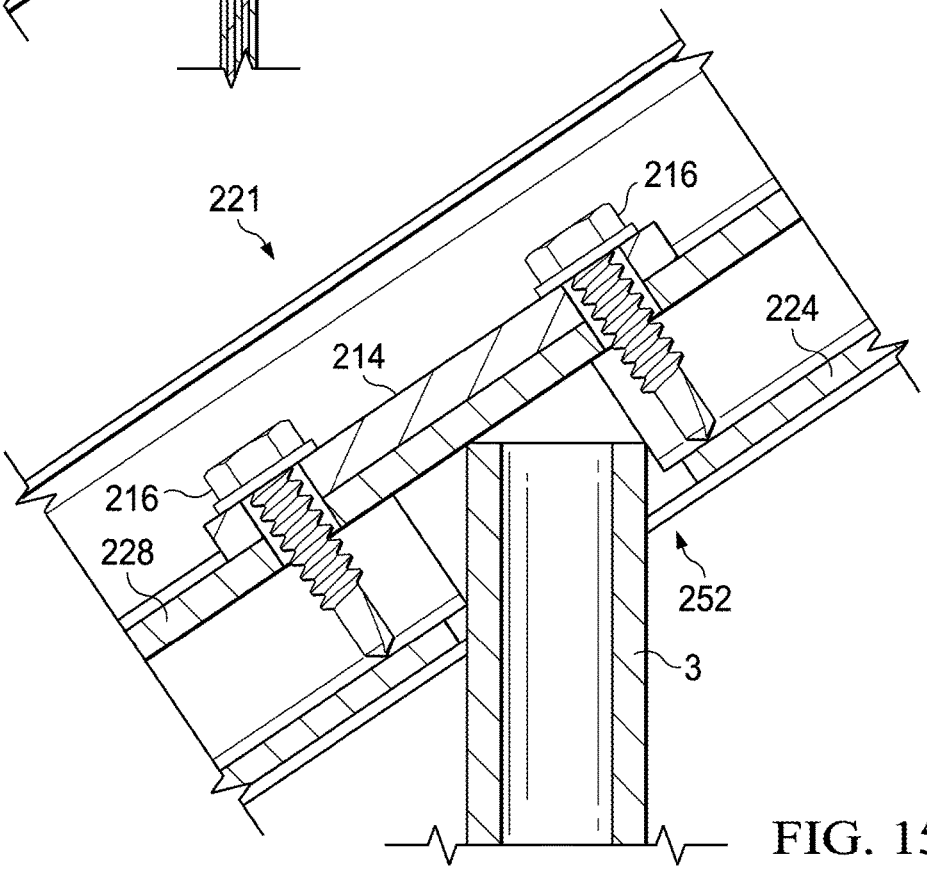
FIG. 15 is a cross-section view of the top rail joined with the rigid support member.

FIG. 15 is a cross-section of the top rail 221 joined with the rigid support member 3. Due to the angle of the stairs, the rigid support member 3 is received by an elongated oblong (i.e. elongated circular) hole 252 through the lower wall 224 of the top rail 221, as shown in FIG. 21A. The holes 252 may extend through the lower wall 224 of the top rail 221 to allow an upper end of the rigid support member 3 to be received by the top rail 221 and abut the internal horizontal wall 228. According to an embodiment, a bar 214 may be provided and secured by a pair of fasteners 216 to the internal horizontal wall 228 of the top rail 221. The bar 214 adds strength to the internal horizontal wall 228. Alternatively, the bar 214 may be omitted. Thus, the installation of the rigid support member 3 with the top rail 221 will appear similar to the junction of the rigid support member 3 and the bottom rail 222, shown in FIG. 17.

Figure 17:
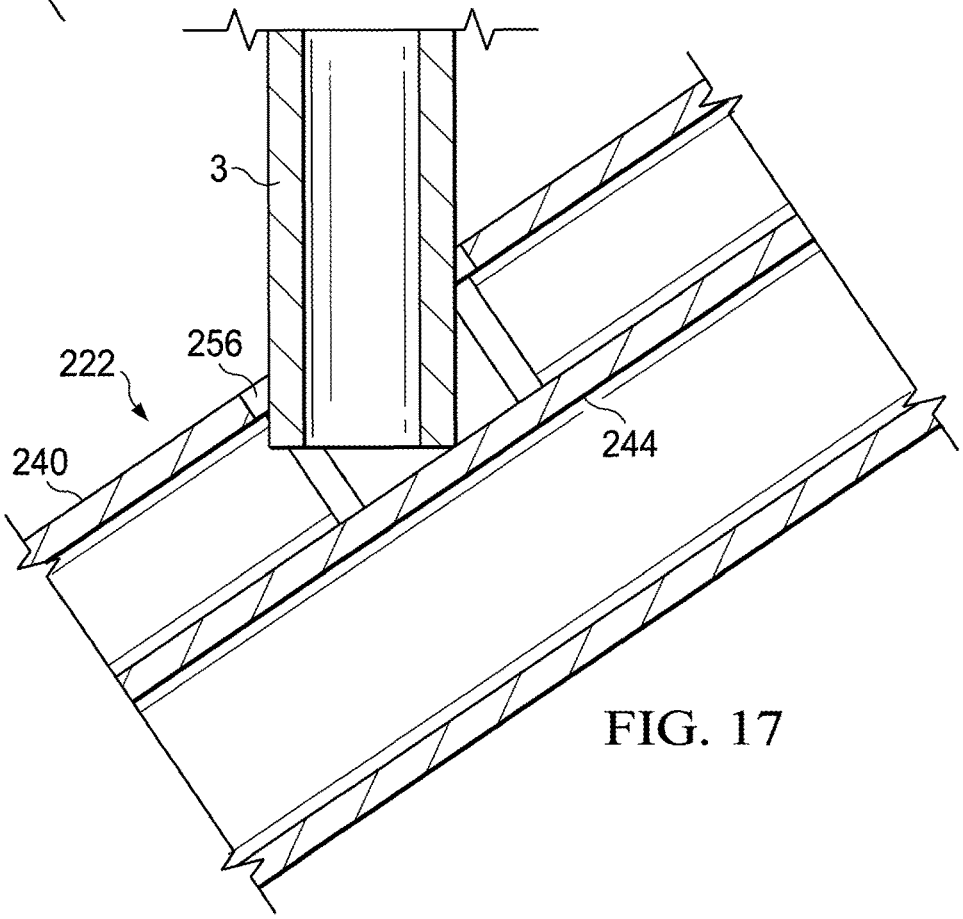
FIG. 17 is cross-section view of the bottom rail joined with the rigid support number.

FIG. 17 illustrates a junction of the bottom rail 222 and the rigid support number 3 taken along the longitudinal axis of the bottom rail 222. The rigid support member 3 is disposed at a non-perpendicular angle, for example a 34 degree angle, with respect to the bottom rail 2. The rigid support member 3 is vertical and parallel with the cables 4. The rigid support member 3 is received through a hole 256 in the upper wall 240 of the bottom rail 222 and contacts the internal horizontal wall 244 of the bottom rail 222. Tightening the tensioning nut 7 on the vertical cables 4 causes the bottom rail 222 to apply a compression force on the rigid support number 3 to thereby more tightly secure the rigid support member 3 between the top rail 221 and the bottom rail 222. Alternatively, the rigid support member 3 may be installed to the angled top rail 221 and the angled bottom rail 222 with a threaded fastener as discussed above with respect to level vertical cable rail panel 100.

Returning to the vertical cable rail panel 100, a method may be provided to assemble the vertical cable rail panel 100. The method may include having cables 4 pre-swaged with the threaded fitting 60 and the cable receiving fitting 70. In other words, the cable 4 is swaged prior to assembly of the vertical cable 4 with the top rail 1 and the bottom rail 2 to form the rail panel 100. The method includes feeding the vertical cable 4 through the top rail 1 and then through the bottom rail 2 via the receiving holes that are configured to receive the ends of the cable 4. The threaded fitting 60 is received through the fastener receiving holes 30. The pair of flanges 64 of the threaded fitting 60 is captured between the internal vertical walls 23 and the internal vertical walls 23 prevent rotation of the threaded fitting 60 when a tensioning nut 7, or any suitable threaded fastener, is threaded to the threads 68. For instance, the threaded fitting 60 may be turned 0.125 of an inch, and then further rotation is restricted by the internal vertical walls 23. The method further includes threading the tensioning nut 7 to the threaded fitting 60, and a washer 90 is compressed between the tensioning nut 7 and the internal horizontal wall 21. Thus, the tensioning nut 7 can be turned to tension the cables 4 without the threaded fitting 60 and the cable 4 rotating. The cable hole 25 allows the cable 4 to extend therethrough, but it is not large enough for the threaded fitting 60 to pass through, such that that swage, or threaded fitting 60 does not extend through the top rail 1.

The method further includes securing the cable 4 by feeding the cable 4 and the clip receiving swage fitting 70 through the holes in the bottom rail 2. The clip receiving swage fitting 70 is received through the upper wall 40 and the internal wall 50. The clip 80 is received through the bottom clip receiving hole 54 and clipped around the clip receiving swage fitting 70. The clip 80 maintains the cable 4 secured to the bottom rail 2. Tightening the tensioning nut 7 will increase tension the cable 4 because the clip 80 will apply a force to the internal horizontal wall 50. The threaded fitting 60 may include 0.25-0.5. inches of threading to allow for adjustability in the tension.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

As utilized herein with respect to numerical ranges, the terms "approximately," "about," "substantially," and similar terms generally mean+/−10% of the disclosed values. When the terms "approximately," "about," "substantially," and similar terms are applied to a structural feature (e.g., to describe its shape, size, orientation, direction, etc.), these terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the vertical cable rail barriers as shown in the various exemplary embodiments is illustrative only. Additionally, any element disclosed in one embodiment may be incorporated or utilized with any other embodiment disclosed herein.

The invention claimed is:

1. A rail panel, comprising:

a top rail comprising a bottom wall, a top wall, and a pair of internal walls running a length of the top rail and extending toward the top wall, the top wall of the top rail defining a plurality of fastener receiving holes spaced apart along the length of the top rail, the bottom wall of the top rail defining a plurality of top cable holes spaced apart along the length of the top rail, the fastener receiving holes being larger in size than the top cable holes;

a bottom rail comprising a top wall, a bottom wall, a first side wall, a second side wall disposed opposite the first side wall, and an internal wall running a length of the bottom rail and extending from the first side wall to the second side wall, the top wall of the bottom rail defining a plurality of bottom cable holes disposed spaced apart along the length of the top wall of the bottom rail, the bottom wall of the bottom rail defining a plurality of clip receiving holes spaced apart along the length of the bottom wall of the bottom rail, the clip receiving holes being larger in size than the bottom cable holes;

a plurality of vertical cables extending from the top rail to the bottom rail, a top end of each the plurality of vertical cables extending through a respective top cable hole, and a bottom end of each of the plurality of vertical cables extending through a respective bottom cable hole;

a plurality of threaded swage fittings, each coupled to a respective top end of one of the plurality of vertical cables, each threaded swage fitting received between the pair of internal walls of the top rail such that the pair of internal walls inhibit rotation of the threaded swage fitting, each of plurality of threaded swage fittings and each of the top cable holes being sized to prevent the threaded swage fitting from passing through the top cable hole;

a plurality of clip receiving swage fittings, each coupled to a respective bottom end of one of the plurality of vertical cables and sized to pass through the bottom cable holes;

a plurality of clips, each received by a respective clip receiving swage fitting, each clip and each bottom cable hole sized to prevent the clip from passing through the bottom cable hole; and a rigid support member extending from the top rail to the bottom rail.

2. The rail panel of claim 1 wherein each threaded swage fitting comprises a flange portion configured to be received between the pair of internal walls of the top rail.

3. The rail panel of claim 1 further comprising a plurality of threaded fasteners, each threaded to a respective threaded swage fitting, wherein turning the threaded fastener adjusts a tension in the associated vertical cable.

4. The rail panel of claim 3 further comprising a cover configured to fit over the top rail and conceal the plurality of fastener receiving holes and the plurality of threaded fasteners.

5. The rail panel of claim 1 further comprising a plurality of angled inserts seated within the top rail, each angled insert receiving a respective threaded swage fitting.

6. The rail panel of claim 5 further comprising a plurality of cam inserts each disposed between a respective clip and the internal wall of the bottom rail, each cam insert having an arcuate surface contacting the internal wall of the bottom rail.

7. The rail panel of claim 1 wherein each clip receiving swage fitting comprises at least one annular recess, each clip being received in a respective annular recess.

8. A rail panel, comprising:

a first rail comprising a bottom wall, a top wall, and a pair of internal walls running a length of the first rail and extending toward the top wall, the top wall of the first rail defining a plurality of fastener receiving holes spaced apart along the length of the first rail, the bottom wall of the first rail defining a plurality of top cable holes spaced apart along the length of the first rail, the fastener receiving holes being larger in size than the top cable holes;

a second rail comprising a top wall, a bottom wall, a first side wall, a second side wall disposed opposite the first side wall, and an internal wall running a length of the second rail and extending from the first side wall to the second side wall, the top wall of the second rail defining a plurality of bottom cable holes disposed spaced apart along the length of the top wall of the second rail, the bottom wall of the second rail defining a plurality of clip receiving holes spaced apart along the length of the bottom wall of the second rail, the clip receiving holes being larger in size than the bottom cable holes;

a plurality of vertical cables extending from the first rail to the second rail, a top end of each the plurality of vertical cables extending through a respective top cable hole, and a bottom end of each of the plurality of vertical cables extending through a respective bottom cable hole;

a plurality of threaded swage fittings, each coupled to a respective top end of one of the plurality of vertical cables, each threaded swage fitting received between the pair of internal walls of the first rail such that the pair of internal walls inhibit rotation of the threaded swage fitting, each of plurality of threaded swage fittings and each of the top cable holes being sized to prevent the threaded swage fitting from passing through the top cable hole;

a plurality of clip receiving swage fittings, each coupled to a respective bottom end of one of the plurality of vertical cables and sized to pass through the bottom cable holes;

a plurality of clips, each received by a respective clip receiving swage fitting, each clip and each bottom cable hole sized to prevent the clip from passing through the bottom cable hole; and a rigid support member extending from the first rail to the second rail.

9. The rail panel of claim 8 wherein each threaded swage fitting comprises a flange portion configured to be received between the pair of internal walls of the first rail.

10. The rail panel of claim 8 further comprising a plurality of threaded fasteners, each threaded to a respective threaded swage fitting, wherein turning the threaded fastener adjusts a tension in the associated vertical cable.

11. The rail panel of claim 10 further comprising a cover configured to fit over the first rail and conceal the plurality of fastener receiving holes and the plurality of threaded fasteners.

12. The rail panel of claim 8 further comprising a plurality of angled inserts seated within the first rail, each angled insert receiving a respective threaded swage fitting.

13. The rail panel of claim 12 further comprising a plurality of cam inserts each disposed between a respective clip and the internal wall of the second rail, each cam insert having an arcuate surface contacting the internal wall of the second rail.

14. The rail panel of claim 8 wherein each clip receiving swage fitting comprises at least one annular recess, each clip being received in a respective annular recess.

15. A rail panel, comprising:

a top rail comprising a bottom wall and a pair of internal walls, the top rail defining a plurality of fastener receiving holes, the bottom wall of the top rail defining a plurality of top cable holes, the fastener receiving holes being larger in size than the top cable holes;

a bottom rail comprising a top wall, a first side wall, a second side wall disposed opposite the first side wall, and an internal wall extending from the first side wall to the second side wall, the top wall of the bottom rail defining a plurality of bottom cable holes;

a plurality of vertical cables extending from the top rail to the bottom rail, a top end of each the plurality of vertical cables extending through a respective top cable hole, and a bottom end of each of the plurality of vertical cables extending through a respective bottom cable hole;

wherein each of the top ends is configured to be received between the pair of internal walls of the top rail and prevented from passing through the top cable hole;

wherein each of the bottom ends is sized to pass through the bottom cable holes; and a plurality of clips configured to couple to the bottom ends and thereby prevent the bottom ends from passing through the respective bottom cable holes.

16. The rail panel of claim 15 further comprising a top wall of the top rail, wherein the top wall of the top rail defines the plurality of fastener receiving holes, the plurality of fastener receiving holes spaced apart along the length of the top rail.

17. The rail panel of claim 15 further comprising a bottom wall of the bottom rail defining a plurality of clip receiving holes, the clip receiving holes being larger in size than the bottom cable holes, the plurality of clip receiving holes spaced apart along the length of the bottom wall of the bottom rail.

18. The rail panel of claim 15 further comprising a plurality of threaded swage fittings each coupled to a respective top end, each threaded swage fitting received between the pair of internal walls of the top rail such that the pair of internal walls inhibit rotation of the threaded swage fittings.

19. The rail panel of claim 15 further comprising a plurality of clip receiving swage fittings each coupled to a respective bottom end.

20. The rail panel of claim 15, further comprising a rigid support member extending from the top rail to the bottom rail.

* * * * *